US007015905B2

(12) United States Patent
Onozawa et al.

(10) Patent No.: US 7,015,905 B2
(45) Date of Patent: Mar. 21, 2006

(54) CAPACITIVE LOAD DRIVING CIRCUIT DRIVING CAPACITIVE LOADS SUCH AS PIXELS IN PLASMA DISPLAY PANELS AND PLASMA DISPLAY APPARATUS HAVING THE CAPACITIVE LOAD DRIVING CIRCUIT

(75) Inventors: Makoto Onozawa, Kawasaki (JP); Yoshinori Okada, Kawasaki (JP); Haruo Koizumi, Kawasaki (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 48 days.

(21) Appl. No.: 10/759,072

(22) Filed: Jan. 20, 2004

(65) Prior Publication Data

US 2004/0201552 A1 Oct. 14, 2004

(30) Foreign Application Priority Data

Apr. 10, 2003 (JP) ..... 2003-106839

(51) Int. Cl.
*G09G 5/00* (2006.01)
*G09G 3/10* (2006.01)

(52) U.S. Cl. ..... 345/212; 315/169.4

(58) Field of Classification Search ..... 315/169.4; 345/60, 212, 77; 332/109; 369/59.12
See application file for complete search history.

(56) References Cited

U.S. PATENT DOCUMENTS

| | | | | |
|---|---|---|---|---|
| 5,311,169 | A * | 5/1994 | Inada et al. | 345/77 |
| 5,471,171 | A * | 11/1995 | Itakura et al. | 330/253 |
| 5,541,542 | A * | 7/1996 | Shibuya et al. | 327/172 |
| 6,329,980 | B1 * | 12/2001 | Uehara et al. | 345/204 |
| 2001/0005188 | A1 * | 6/2001 | Watanabe | 345/60 |
| 2001/0055258 | A1 * | 12/2001 | Carson et al. | 369/59.12 |
| 2002/0054001 | A1 * | 5/2002 | Awamoto | 345/60 |
| 2002/0075746 | A1 * | 6/2002 | Ooishi | 365/230.03 |
| 2002/0097203 | A1 * | 7/2002 | Onozawa et al. | 345/67 |

FOREIGN PATENT DOCUMENTS

| | | |
|---|---|---|
| EP | 1 139 323 A2 | 10/2001 |
| JP | 2001-282181 | 10/2001 |
| JP | 2001358570 | * 12/2001 |
| JP | 2002-215087 | 7/2002 |

* cited by examiner

*Primary Examiner*—Wilson Lee
*Assistant Examiner*—Angela M Lie
(74) *Attorney, Agent, or Firm*—Staas & Halsey LLP

(57) ABSTRACT

A capacitive load driving circuit has an input terminal, a front-edge delay circuit, a back-edge delay circuit, an amplifying circuit, and an output switch device driven by the amplifying circuit. The front-edge delay circuit delays a front edge of an input signal input via the input terminal, the back-edge delay circuit delays a back edge of the input signal, and the amplifying circuit amplifies a drive control signal obtained through the front-edge delay circuit and the back-edge delay circuit.

42 Claims, 24 Drawing Sheets

51 (52~53)

Fig.7A
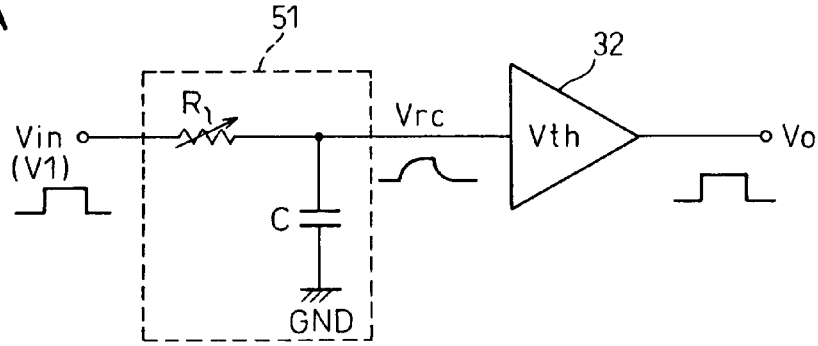
Fig.7B
Fig.7C
Fig.7D
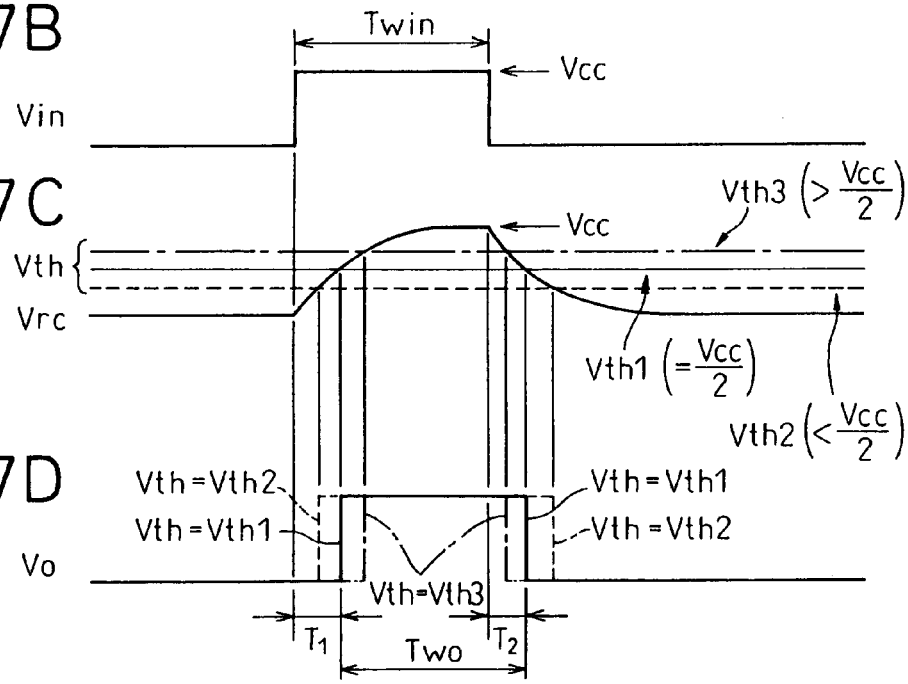

CAPACITIVE LOAD DRIVING CIRCUIT DRIVING CAPACITIVE LOADS SUCH AS PIXELS IN PLASMA DISPLAY PANELS AND PLASMA DISPLAY APPARATUS HAVING THE CAPACITIVE LOAD DRIVING CIRCUIT

CROSS REFERENCE TO RELATED APPLICATION

This application is based upon and claims the benefit of priority from the prior Japanese Patent Application No. 2003-106839, filed on Apr. 10, 2003, the entire contents of which are incorporated herein by reference.

BACKGROUND OF THE INVENTION

1. Field of the Invention

The present invention relates to a capacitive load driving circuit and a plasma display apparatus and, more particularly, to a capacitive load driving circuit for driving capacitive loads such as pixels in plasma display panels (PDPs), and also to a plasma display apparatus.

2. Description of the Related Art

In recent years, plasma display apparatuses have been commercially implemented as thin display apparatuses. In a capacitive load driving circuit for driving capacitive loads such as pixels in a plasma display panels, if a delay time is adjusted by a delay circuit, variations may be caused in the pulse width of sustain pulses. For example, if the pulse width of the sustain pulses increases, a reduction in time margin, the occurrence of an abnormal current, etc. may result.

On the other hand, if the pulse width of sustain pulses decreases, noise may be superimposed on the rising and falling waveforms of a sustain voltage, reducing the operating margin of the plasma display apparatus and resulting in the occurrence of screen flicker.

It is therefore desired to provide a capacitive load driving circuit that can supply a proper output voltage to each capacitive load by reducing the variation in output pulse width that occurs when a delay time is adjusted by a delay circuit. It is also desired to provide a plasma display apparatus that can supply a plasma display panel with a drive voltage free from such problems as the reduction of time margin, the occurrence of abnormal current, the superimposition of noise, etc.

The prior art and its associated problem will be described in detail, later, with reference to the relevant drawings.

SUMMARY OF THE INVENTION

An object of the present invention is to provide a capacitive load driving circuit that can supply a proper output voltage to each capacitive load by reducing the variation in output signal pulse width that occurs when a delay time is adjusted by a delay circuit. Another object of the invention is to provide a plasma display apparatus that can supply a plasma display panel with a drive voltage free from such problems as the reduction of time margin, the occurrence of abnormal current, the superimposition of noise, etc.

According to the present invention, there is provided a capacitive load driving circuit comprising an input terminal; a front-edge delay circuit for delaying a front edge of an input signal input via the input terminal; a back-edge delay circuit for delaying a back edge of the input signal; an amplifying circuit for amplifying a drive control signal obtained through the front-edge delay circuit and the back-edge delay circuit; and an output switch device which is driven by the amplifying circuit.

Further, according to the present invention, there is provided a plasma display apparatus comprising a plurality of X electrodes; a plurality of Y electrodes which are arranged substantially parallel to the plurality of X electrodes, and which produce a discharge between the plurality of Y electrodes and the plurality of X electrodes; an X-electrode driving circuit which applies a discharge voltage to the plurality of X electrodes; and a Y-electrode driving circuit which applies a discharge voltage to the plurality of Y electrodes, and wherein the X-electrode driving circuit or the Y-electrode driving circuit is constructed using a capacitive load driving circuit, wherein the capacitive load driving circuit comprises an input terminal; a front-edge delay circuit for delaying a front edge of an input signal input via the input terminal; a back-edge delay circuit for delaying a back edge of the input signal; an amplifying circuit for amplifying a drive control signal obtained through the front-edge delay circuit and the back-edge delay circuit; and an output switch device which is driven by the amplifying circuit.

The front-edge delay circuit may be a rising edge delay circuit for delaying a rising edge of the input signal; and the back-edge delay circuit may be a falling edge delay circuit for delaying a falling edge of the input signal. The input signal may be a positive polarity pulse signal.

The front-edge delay circuit may be a falling edge delay circuit for delaying a falling edge of the input signal; and the back-edge delay circuit may be a rising edge delay circuit for delaying a rising edge of the input signal. The input signal may be a negative polarity pulse signal.

The rising edge delay circuit may comprise a capacitive element and a parallel circuit of a resistive element and a switch element and, wherein when the input signal rises, the capacitive element may be charged through the resistive element and, when the input signal falls, the capacitive element may be discharged through the switch element. The switch element in the rising edge delay circuit may be a diode. The delay time of the rising edge delay circuit may be adjusted by varying the resistance value of the resistive element. The delay time of the rising edge delay circuit may be adjusted by varying the capacitance value of the capacitive element.

The falling edge delay circuit may comprise a capacitive element and a parallel circuit of a resistive element and a switch element and, wherein when the input signal falls, the capacitive element may be charged through the resistive element and, when the input signal rises, the capacitive element may be discharged through the switch element. The switch element in the falling edge delay circuit may be a diode. The delay time of the falling edge delay circuit may be adjusted by varying the resistance value of the resistive element. The delay time of the falling edge delay circuit may be adjusted by varying the capacitance value of the capacitive element.

The front-edge delay circuit may be a first monostable multivibrator which is triggered by the front edge of the input signal; and the back-edge delay circuit may be a second monostable multivibrator which is triggered by the back edge of the input signal, and wherein the drive control signal may be generated by combining an output signal of the first monostable multivibrator with an output of the second monostable multivibrator.

The front-edge delay circuit may comprise a first capacitive element and a first series circuit having a first resistive element and a first switch element; and the back-edge delay circuit may comprise a second capacitive element and a second series circuit having a second resistive element and a second switch element and, wherein the first series circuit and the second series circuit may be connected in parallel. The first capacitive element and the second capacitive element may be together constructed as one common capacitive element. The delay time of the front edge of the input signal may be adjusted by varying the resistance value of the first resistive element, and delay time of the back edge of the input signal may be adjusted by varying the resistance value of the second resistive element. The first switch element and the second switch element may be diodes.

The front-edge delay circuit may comprise a first resistive element and a first capacitive element; and the back-edge delay circuit may comprise a second capacitive element and a series circuit having a second resistive element and a switch element and, wherein the first resistive element and the series circuit may be connected in parallel. The first capacitive element and the second capacitive element may be together constructed as one common capacitive element. The delay time of the front edge of the input signal may be adjusted by varying the resistance value of the first resistive element, and delay time of the back edge of the input signal may be adjusted by varying the resistance value of the second resistive element. The delay time of the front edge of the input signal may be adjusted by varying the resistance value of the first resistive element, and thereafter, delay time of the back edge of the input signal may be adjusted by varying the resistance value of the second resistive element. The switch element may be a diode.

The front-edge delay circuit may comprise a first counter which starts to count a clock signal from the front edge of the input signal; and the back-edge delay circuit may comprise a second counter which starts to count the clock signal from the back edge of the input signal, and wherein the delay time of the front edge may be adjusted by varying a count value of the first counter, and delay time of the back edge may be adjusted by varying a count value of the second counter. The first counter and the second counter may be formed on the same semiconductor integrated circuit.

According to the present invention, there is also provided a capacitive load driving circuit comprising an input terminal; a front-edge delay circuit for delaying a front edge of an input signal input via the input terminal; a pulse width adjusting circuit for generating a drive control signal having a prescribed pulse width from a delayed signal obtained through the front-edge delay circuit; an amplifying circuit for amplifying the drive control signal; and an output switch device which is driven by the amplifying circuit.

In addition, according to the present invention, there is provided a plasma display apparatus comprising a plurality of X electrodes; a plurality of Y electrodes which are arranged substantially parallel to the plurality of X electrodes, and which produce a discharge between the plurality of Y electrodes and the plurality of X electrodes; an X-electrode driving circuit which applies a discharge voltage to the plurality of X electrodes; and a Y-electrode driving circuit which applies a discharge voltage to the plurality of Y electrodes, and wherein the X-electrode driving circuit or the Y-electrode driving circuit is constructed using a capacitive load driving circuit, wherein the capacitive load driving circuit comprises an input terminal; a front-edge delay circuit for delaying a front edge of an input signal input via the input terminal; a pulse width adjusting circuit for generating a drive control signal having a prescribed pulse width from a delayed signal obtained through the front-edge delay circuit; an amplifying circuit for amplifying the drive control signal; and an output switch device which is driven by the amplifying circuit.

The front-edge delay circuit may comprise a resistive element and a capacitive element; and the pulse width adjusting circuit may be a monostable multivibrator. The delay time of the input signal may be adjusted by varying the resistance value of the resistive element in the front-edge delay circuit. The delay time of the input signal may be adjusted by varying the capacitance value of the capacitive element in the front-edge delay circuit. The pulse width of the drive control signal may be adjusted by varying a time constant and the like of the monostable multivibrator.

The front-edge delay circuit may be a first counter for counting a clock signal; and the pulse width adjusting circuit may be a second counter for counting the clock signal, and wherein the delay time of the input signal may be adjusted by varying a count value of the first counter, and the pulse width of the drive control signal may be adjusted by varying a count value of the second counter.

The front-edge delay circuit may be a rising edge delay circuit for delaying a rising edge of the input signal; and the pulse width adjusting circuit may be a monostable multivibrator. The input signal may be a positive polarity pulse signal. The front-edge delay circuit may be a falling edge delay circuit for delaying a falling edge of the input signal; and the pulse width adjusting circuit may be a monostable multivibrator. The input signal may be a negative polarity pulse signal.

The capacitive load driving circuit may comprise a first and a second capacitive load driving circuit; a first output switch device in the first capacitive load driving circuit may be connected between a power line and a capacitive load; and a second output switch device in the second capacitive load driving circuit may be connected between the capacitive load and a reference voltage. The capacitive load driving circuit may further comprise a third and a fourth capacitive load driving circuit; a third output switch device in the third capacitive load driving circuit may be connected to the capacitive load via a first coil; and a fourth output switch device in the fourth capacitive load driving circuit may be connected to the capacitive load via a second coil. The power supply line may be a sustain power supply line of a plasma display apparatus.

BRIEF DESCRIPTION OF THE DRAWINGS

The present invention will be more clearly understood from the description of the preferred embodiments as set forth below with reference to the accompanying drawings, wherein:

FIGS. 7A, 7B, 7C, and 7D are diagrams for explaining the relationship of threshold voltage to output pulse width of an amplifying circuit in the prior art sustain circuit;

DESCRIPTION OF THE PREFERRED EMBODIMENTS

Before describing in detail the preferred embodiments of a capacitive load driving circuit and a plasma display apparatus according to the present invention, capacitive load driving circuits and plasma display apparatuses according to the prior art and their associated problems will be described below with reference to FIGS. 1 to 10.

In recent years, the plasma display panel has been commercially implemented as a display panel that will supersede the traditional CRT, because of its excellent visibility as a self-emitting display, its thin construction, and its ability to provide a large-screen, fast-response display.

Figure 1:
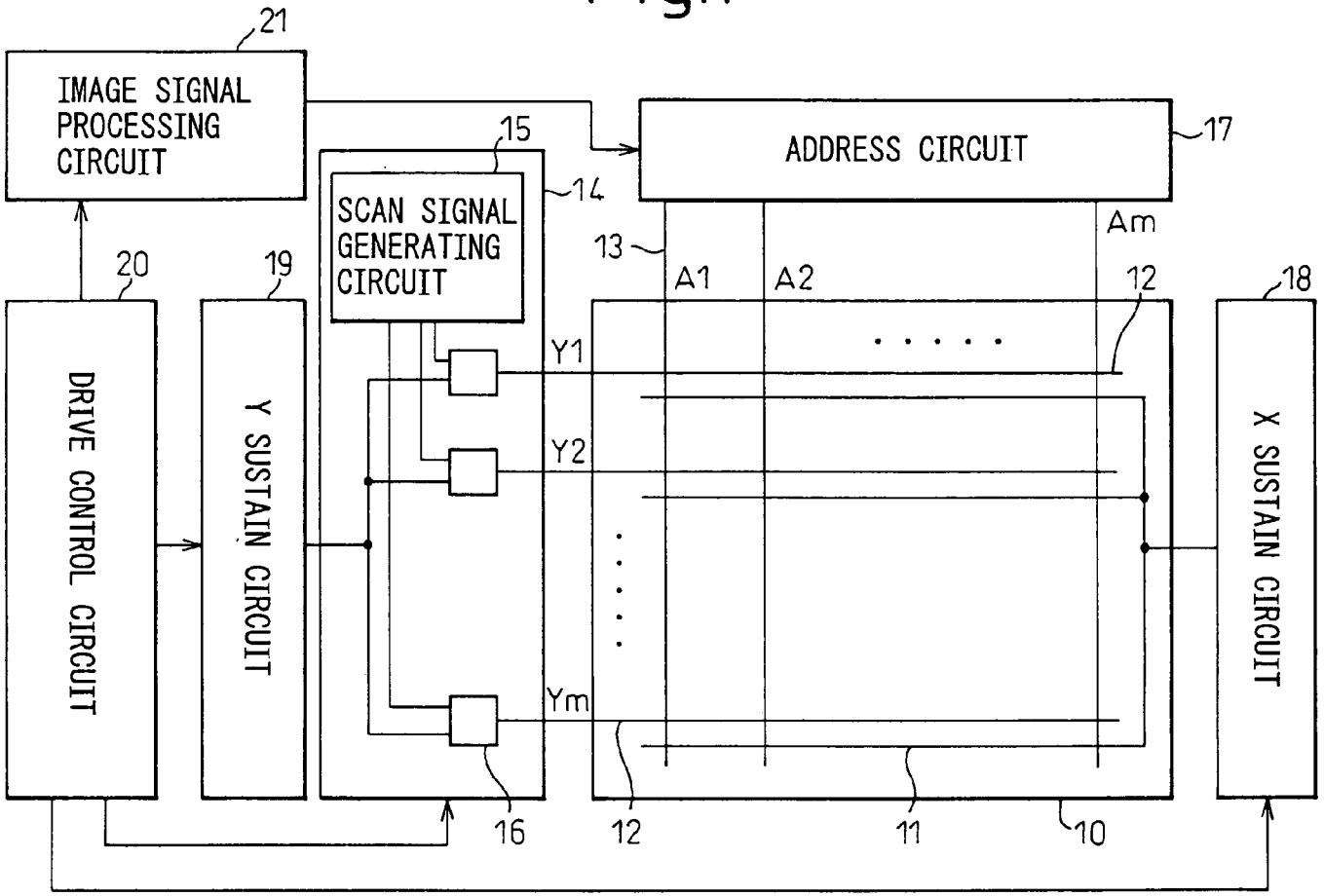
FIG. 1 is a general configuration diagram schematically showing a plasma display apparatus to which the present invention is applied.

FIG. 1 is a general configuration diagram schematically showing a plasma display apparatus to which the present invention is applied; the plasma display apparatus shown here is a conventional three-electrode surface-discharge AC plasma display apparatus. In FIG. 1, reference numeral 10 is a PDP, 11 is a first electrode (X electrode), 12 is a second electrode (Y electrode), 13 is an address electrode, and 14 is a scan driver.

As shown in FIG. 1, in the conventional PDP 10, a number, n, of X electrodes 11 and an equal number of Y electrodes 12 (Y1 to Yn) are arranged alternately and paired in adjacent positions, forming n pairs of X electrodes 11 and Y electrodes 12, and the emission of light for display is caused to occur between the X electrode 11 and the Y electrode 12 in each pair. The Y electrodes and the X electrodes are called the display electrodes; they are also, sometimes, called the sustain electrodes. A number, m, of address electrodes 13 (A1 to Am) are arranged at right angles to the display electrodes, and a display cell is formed at an intersection between each address electrode 13 and each pair of X electrode 11 and Y electrode 12.

The Y electrodes 12 are connected to the scan driver 14. The scan driver 14 includes switches 16 the number of which is equal to the number of Y electrodes, and drives the switches 16 in such a manner that, in an address period, scan pulses from a scan signal generating circuit 15 are applied in sequence and, in a sustain-discharge period, sustain pulses from a Y sustain circuit 19 are applied simultaneously. The X electrodes 11 are connected in common to an X sustain circuit 18, and the address electrodes 13 are connected to an address driver 17. An image signal processing circuit 21 supplies an image signal to the address circuit 17 after converting it into a form that can be handled within the plasma display apparatus. A drive control circuit 20 generates and supplies signals for controlling the various parts of the plasma display apparatus.

Figure 2:
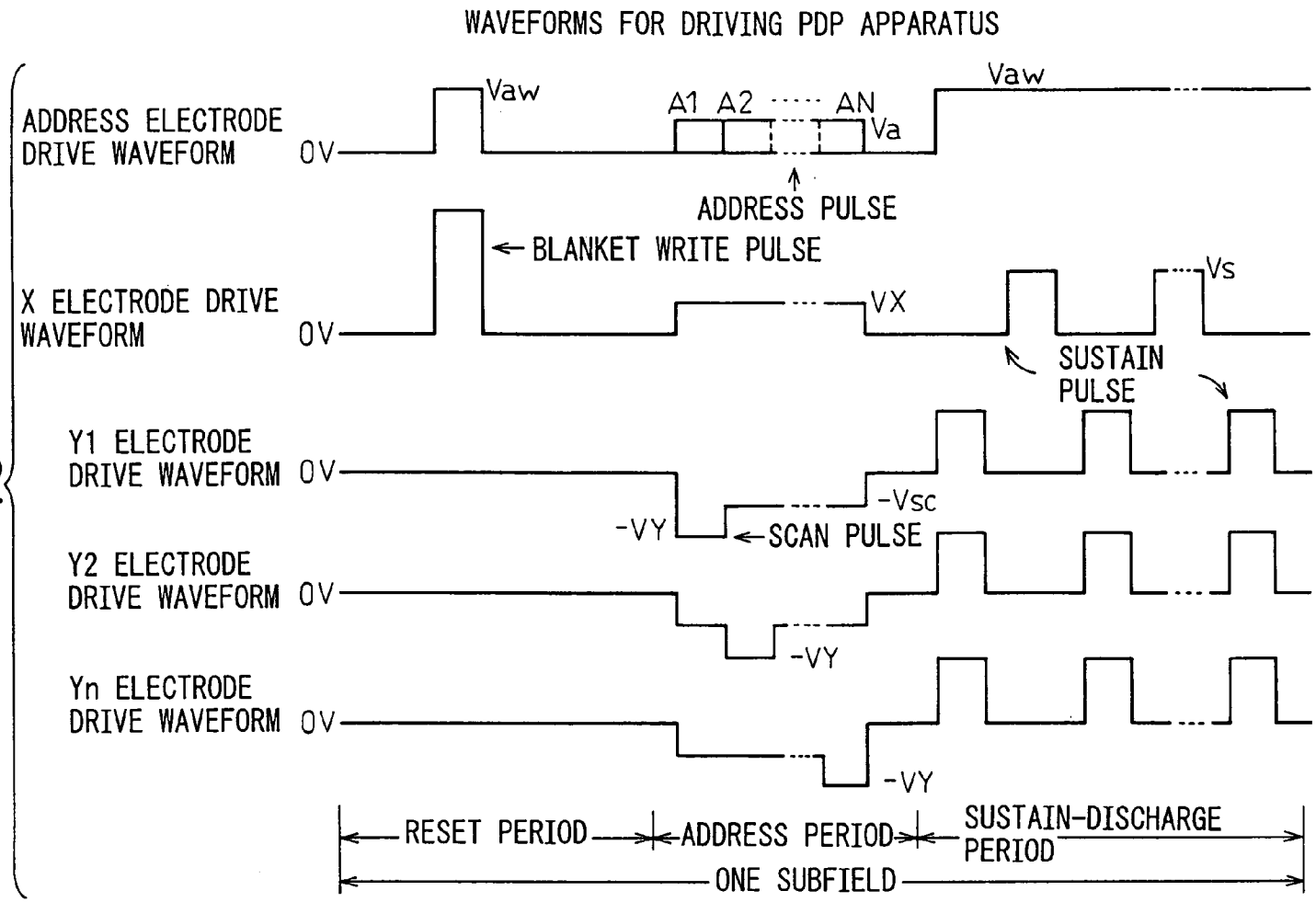
FIG. 2 is a diagram showing waveforms for driving the plasma display apparatus shown in FIG. 1.

FIG. 2 is a diagram showing waveforms for driving the plasma display apparatus shown in FIG. 1.

The plasma display apparatus displays a screen by refreshing the screen every predetermined period, and one display period is called one field. To achieve grayscale display, one field is further divided into a plurality of subfields, and the display is produced by combining the subfields for light emission for each display cell. Each subfield consists of a reset period in which all the display cells are initialized, an address period in which all the display cells are set to the states corresponding to the image to be displayed, and a sustain-discharge (sustain) period in which each display cell is caused to emit light according to the thus set state. During the sustain-discharge period, sustain pulses are applied to the X electrodes and Y electrodes in alternating fashion, causing the sustain-discharge to occur in the display cells that have been set in the address period to emit light, and thus maintaining the emission of light from the cells for display.

In the plasma display apparatus, a voltage of a maximum of about 200 V must to be applied, in the form of high frequency pulses, to the electrodes during the sustain-discharge period; in particular, in the case of a grayscale display using the subfield display scheme, the pulse width is several microseconds. Since the plasma display apparatus is driven by such a high-voltage, high-frequency signal, the power consumption of the plasma display apparatus is generally large, and it is desired to reduce the power consumption.

Figure 3:
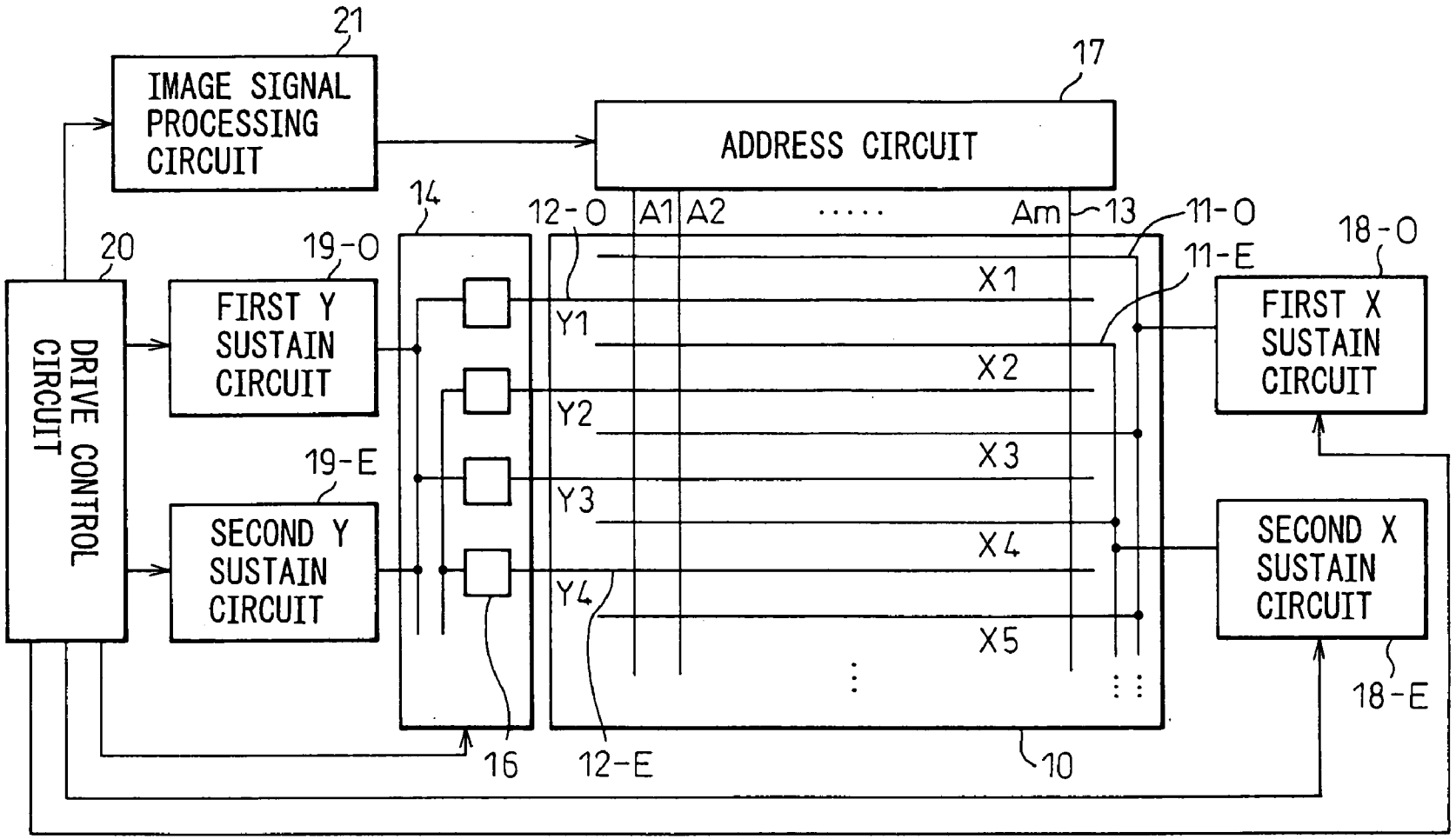
FIG. 3 is a general configuration diagram schematically showing another example of the plasma display apparatus to which the present invention is applied.

FIG. 3 is a general configuration diagram schematically showing another example of the plasma display apparatus to which the present invention is applied; a plasma display apparatus employing a method called ALIS (Alternate Lighting of Surfaces) is shown here.

As shown in FIG. 3, in the PDP employing the ALIS method, a number, n, of Y electrode (second electrodes) 12-O and 12-E and a number, (n+1), of X electrodes (first electrodes) 11-O and 11-E are arranged alternately in an interleaved fashion, and the emission of light for display is caused to occur between every adjacent display electrodes (Y electrode and X electrode). Accordingly, with (2n+1) display electrodes, 2n display lines are formed. That is, the ALIS method achieves twice as high a resolution, while using substantially the same number of display electrodes, as those shown in the configuration of FIG. 1. Further, as effective use can be made of the discharge space, and as the amount of light blocked by the electrodes, etc. is reduced, the method has the advantage of being able to achieve high aperture ratio and, hence, a high brightness. In the ALIS method, the space between every adjacent display electrodes is used to produce a discharge for display, but such discharges cannot be made to occur simultaneously across the entire screen. Therefore, the so-called interlaced scanning technique is employed that produces the display by scanning the odd-numbered lines and the even-numbered lines in a time division fashion. That is, in an odd-numbered field, the odd-numbered lines are scanned, and in an even-numbered field, the even-numbered lines are scanned, thus obtaining a complete display by combining the display produced in the odd-numbered field with the display produced in the even-numbered field.

The Y electrodes are connected to the scan driver 14. The scan driver 14 includes switches 16, which are driven so that, in an address period, scan pulses are applied in sequence and, in a sustain-discharge period, the odd-numbered Y electrodes 12-O are connected to a first Y sustain circuit 19-O and the even-numbered Y electrodes 12-E to a second Y sustain circuit 19-E. At this time, the odd-numbered X electrodes 11-O are connected to a first X sustain circuit 18-O and the even-numbered X electrodes 11-E to a second X sustain circuit 18-E. The address electrodes 13 are connected to the address driver 17. The image signal processing circuit 21 and the drive control circuit 20 perform the same operation as previously described with reference to FIG. 1.

Figure 4A:
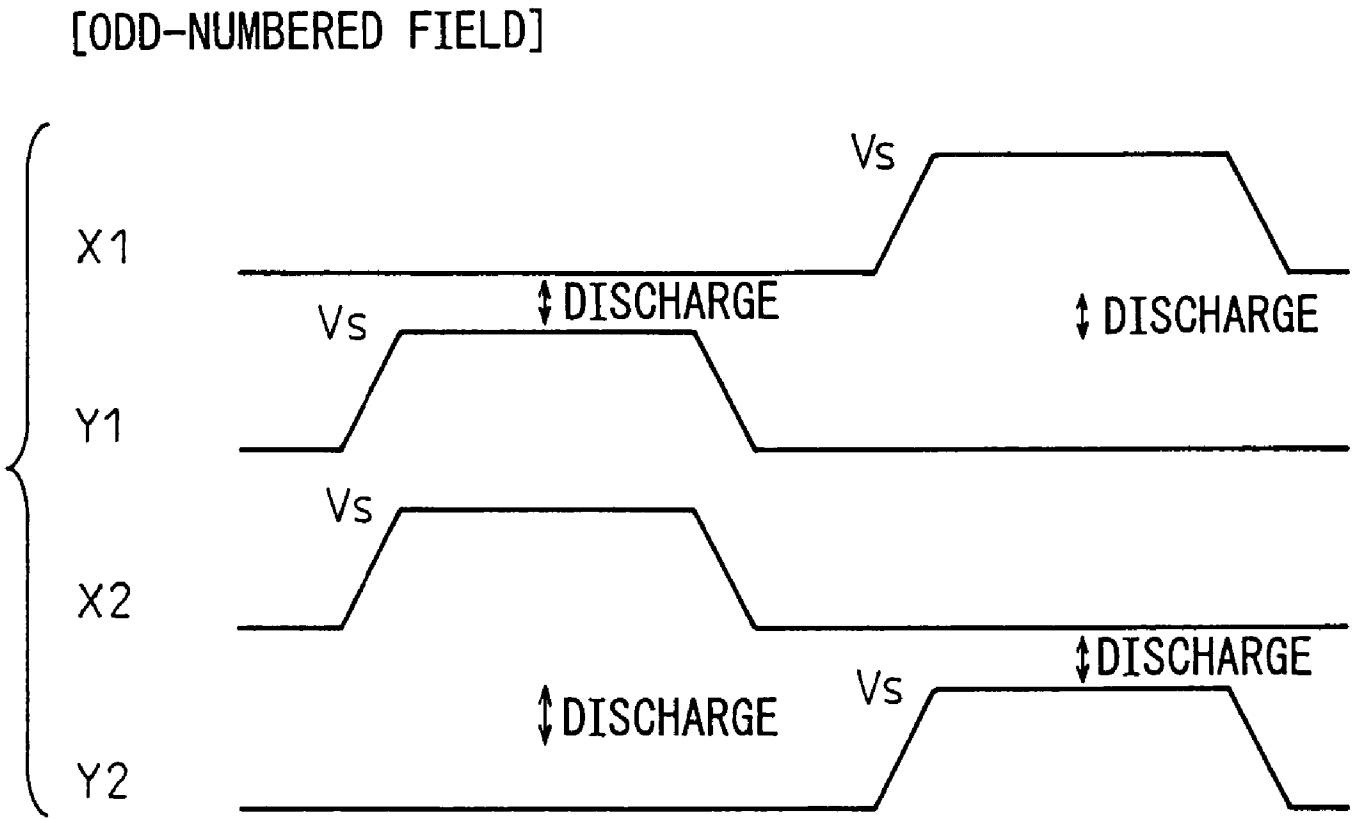
FIGS. 4A and 4B are diagrams showing the drive waveforms applied during a sustain-discharge period in the plasma display apparatus shown in FIG. 3.
Figure 4B:
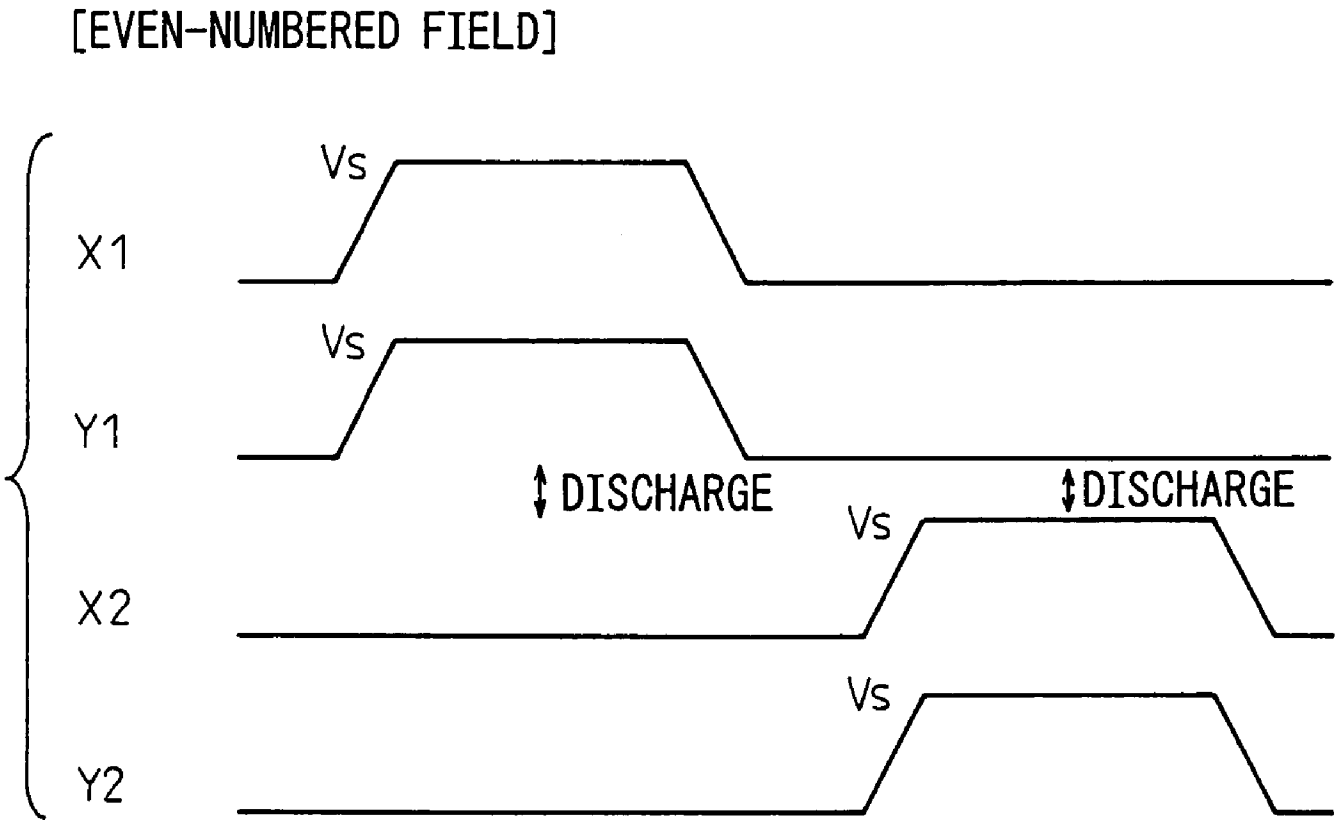

FIGS. 4A and 4B are diagrams showing the drive waveforms applied during the sustain-discharge period in the plasma display apparatus shown in FIG. 3: FIG. 4A shows the waveforms in the odd-numbered field, and FIG. 4B shows the waveforms in the even-numbered field. In the odd-numbered field, voltage Vs is applied to the electrodes Y1 and X2, while X1 and Y2 are held at ground level, thus causing a discharge to occur between the electrodes X1 and Y1 and between the electrodes X2 and Y2, that is, on the odd-numbered display lines. At this time, no discharge occurs on the even-numbered display line between the electrodes Y1 and X2 because the potential difference between them is zero. Likewise, in the even-numbered field, voltage Vs is applied to the electrodes X1 and Y2, while Y1 and X2 are held at ground, thus causing a discharge to occur between the electrodes Y1 and X2 and between the electrodes Y2 and X1, that is, on the even-numbered display lines. Drive waveforms for the reset period and the address period will not be described here.

In the prior art, there is proposed a plasma display apparatus that includes a sustain circuit designed so as to eliminate variations in the rise/fall timing, and the shape, of sustain pulses, thereby reducing power consumption while preventing a malfunction (for example, Japanese Unexamined Patent Publication No. 2001-282181).

Figure 5:
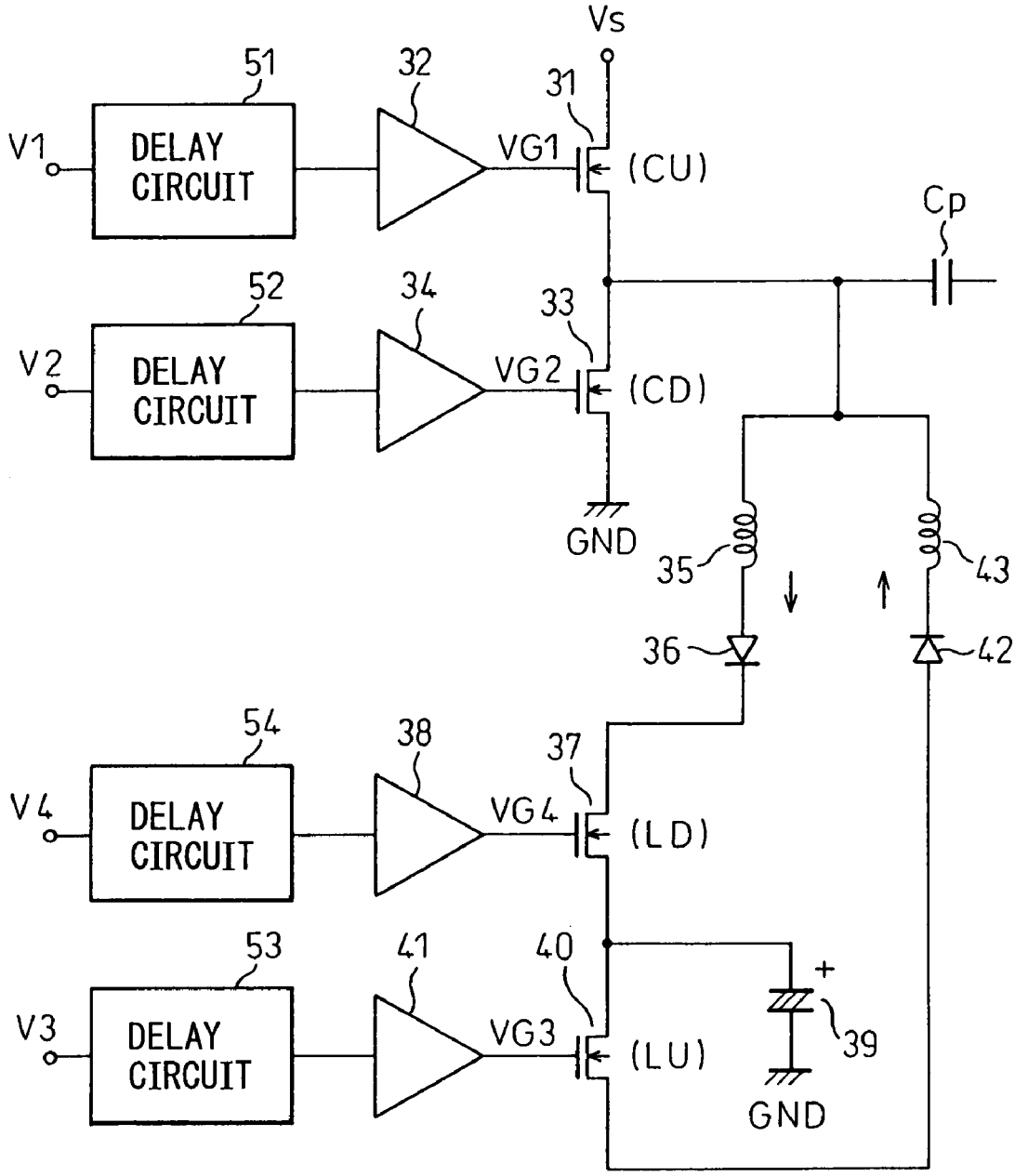
FIG. 5 is a circuit diagram showing one example of a sustain circuit used in a prior art plasma display apparatus.

FIG. 5 is a circuit diagram showing one example of the sustain circuit (capacitive load driving circuit) used in the prior art plasma display apparatus; the sustain circuit shown here has a power recovery circuit in which a recovery path for recovering power and an application path for applying stored power are separated. A circuit for generating signals V1 to V4 is also provided, but not shown here. Reference character Cp indicates a drive capacitor for the display cell formed between an X electrode and a Y electrode in the PDP (10). In FIG. 5, the sustain circuit for one electrode is shown, but it will be noted that a similar sustain circuit is provided for the other electrode.

First, the sustain circuit without the power recovery circuit comprises switch devices (sustain output devices: n-channel MOS transistors) 31 and 33, amplifying circuits (drive circuits) 32 and 34, and delay circuits (front-edge delay circuits) 51 and 52, while the power recovery circuit comprises switch devices 37 and 40, amplifying circuits 38 and 41, and delay circuits (front-edge delay circuits) 54 and 53.

The input signals V1 and V2 are input to the amplifying circuits 32 and 34 via the respective delay circuits 51 and 52, and the signals VG1 and VG2 output from the respective amplifying circuits 32 and 34 are supplied to the gates of the respective switch devices 31 and 33. Here, when the input signal V1 is at a high level "H", the switch device 31 turns on, and a high level "H" signal is applied to the electrode (X electrode or Y electrode). At this time, the input signal V2 is at a low level "L", and hence, the switch device 33 is OFF. At the same time that the input signal V1 goes to the low level "L", causing the switch device 31 to turn off, the input signal V2 goes to the high level "H", causing the switch device 33 to turn on, and ground level potential is thus applied to the electrode.

On the other hand, when applying a sustain pulse in the sustain circuit having the power recovery circuit, before the input signal V1 goes to the high level "H" the input signal V2 goes to the low level "L" thus causing the switch device 33 to turn off, after which the input signal V3 goes to the high level "H" and the switch device 40 turns on, forming a resonant circuit by a capacitor 39, diode 42, inductance 43, and capacitor Cp, and the power stored in the capacitor 39 is supplied to the electrode, causing the potential of the electrode to rise. Immediately before the rise of the electrode potential ends, the input signal V3 goes to the low level "L", causing the switch device 40 to turn off, and at the same time, the input signal V1 goes to the high level "H", causing the switch device 31 to turn on, and thus holding the electrode potential fixed at Vs.

When ending the application of the sustain pulse, first the input signal V1 goes to the low level "L" thus causing the switch device 31 to turn off, after which the input signal V4 goes to the high level "H" and the switch device 37 turns on, forming a resonant circuit by the capacitor 39, the diode 36, the inductance 35 and the capacitor Cp, and the charge stored in the capacitor Cp is supplied to the capacitor 39, thus causing the voltage at the capacitor 39 to rise. In this way, the power stored in the capacitor Cp by the sustain pulse applied to the electrode is recovered and stored in the capacitor 39. Immediately before the fall of the electrode potential ends, the input signal V4 goes to the low level "L", causing the switch device 37 to turn off and, at the same time, the input signal V2 goes to the high level "H", causing the switch device 33 to turn on, thus holding the electrode potential fixed to ground. In the sustain-discharge period, the above operation is repeated as many times as there are sustain pulses. With the above configuration, power consumption associated with the sustain discharge can be reduced.

Figure 6:
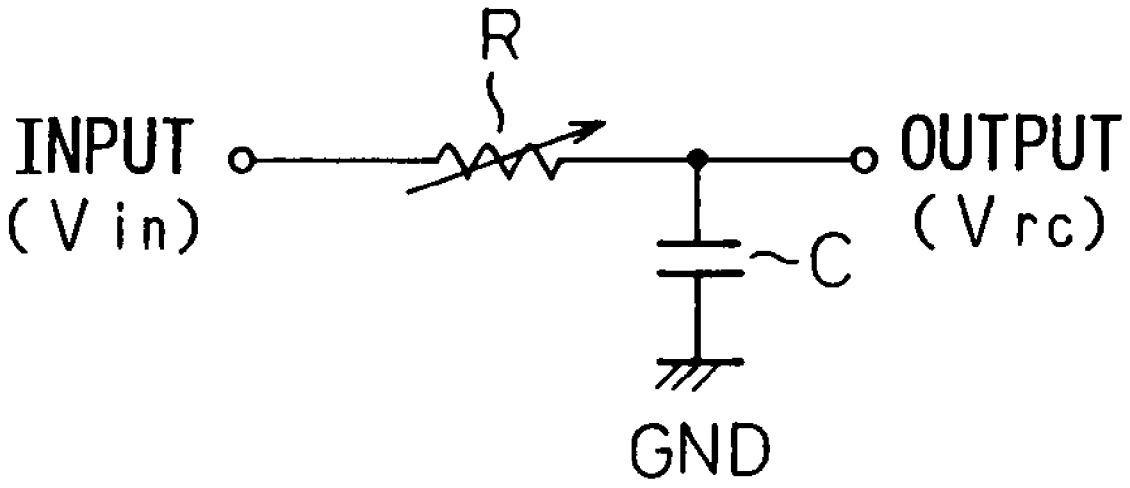
FIG. 6 is a circuit diagram showing one example of a delay circuit in the sustain circuit shown in FIG. 5.

FIG. 6 is a circuit diagram showing one example of the delay circuit in the sustain circuit shown in FIG. 5.

As shown in FIG. 6, the delay circuit 51 (52 to 54), which is a circuit for delaying the front edge of the input signal V1 (V2 to V4) input via an input terminal, comprises a variable resistor (variable resistive element) R and a capacitor (capacitive element) C, and controls the delay time of the input signal by varying the resistance value of the variable resistor R. That is, the delay circuits 51, 52, 53, and 54 correct for variations in the delay times of the respective amplifying circuits 32, 34, 41, and 38 connected at the subsequent stage, and thereby adjust the phase of the drive pulse to be applied to each switch device so that the switch devices 31, 33, 40, and 37 can be driven at the proper timings.

It thus becomes possible to supply sustain pulses of correct timing to the plasma display panel, while suppressing an increase in power consumption caused by variations in the delay times of the amplifying circuits.

In a driving apparatus for an AC PDP, if the power recovery circuit fails to operate properly, output loss in the driving apparatus increases, increasing the amount of heat generated by each component forming the driving apparatus; to address this, there is proposed in the prior art a plasma display apparatus wherein provisions are made to be able to prevent the occurrence of damage, such as device breakdown, when the power recovery circuit fails to operate properly, without having to construct the driving apparatus by using high-breakdown voltage components (for example, Japanese Unexamined Patent Publication No. 2002-215087).

Figure 8A:
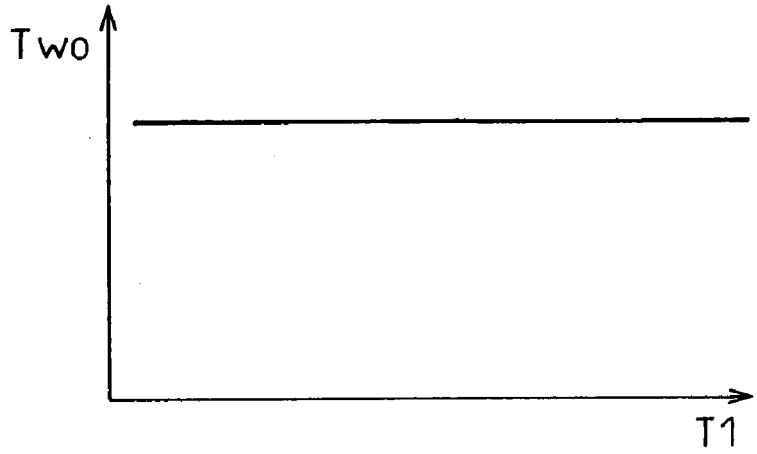
FIGS. 8A, 8B, and 8C are diagrams for explaining the relationship of delay time to output pulse width in the prior art sustain circuit.
Figure 8B:
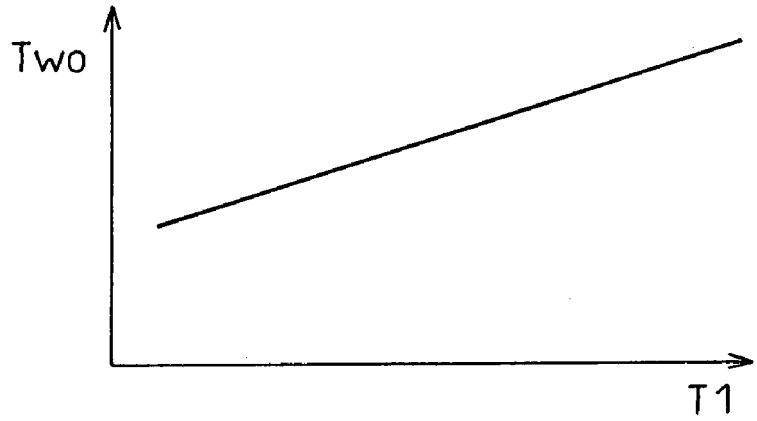
Figure 8C:
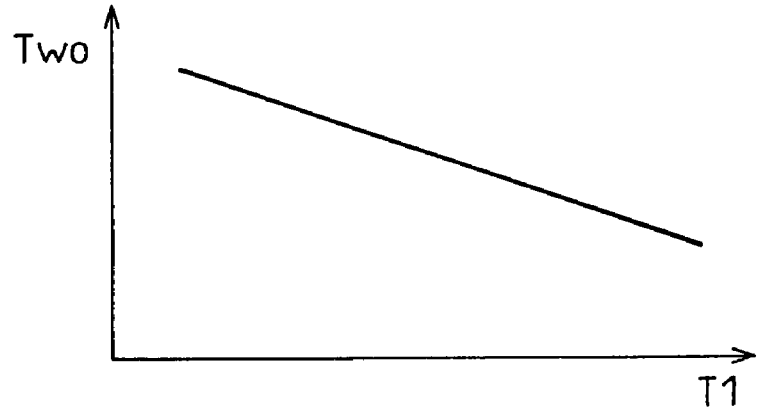
Figure 9:
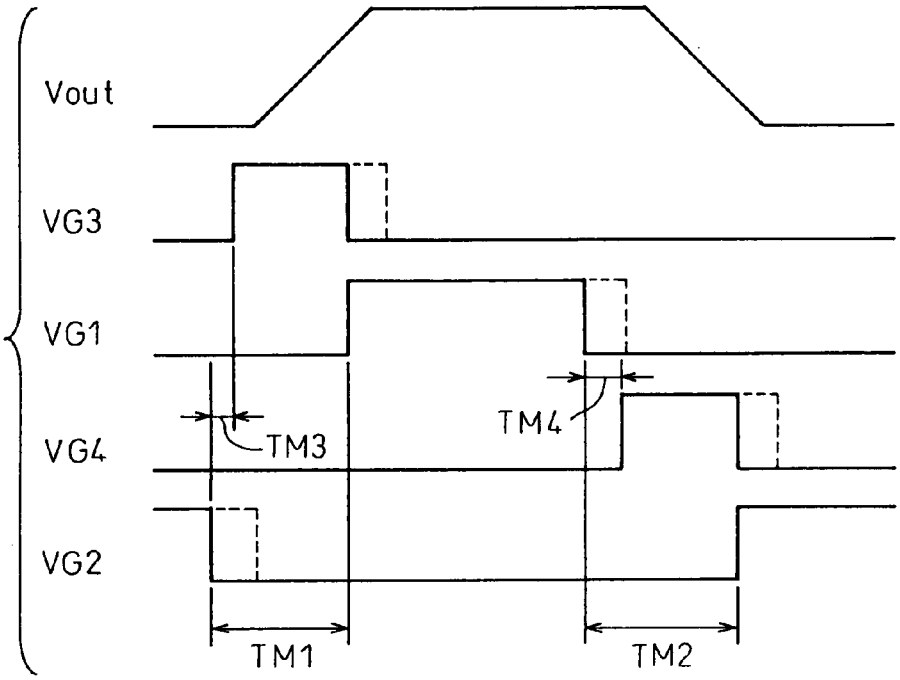
FIG. 9 is a diagram showing operating waveforms when the output pulse width is large in the prior art sustain circuit.

FIGS. 7A, 7B, 7C, and 7D are diagrams for explaining the relationship of threshold voltage to output pulse width of an amplifying circuit in the prior art sustain circuit, and more specifically for explaining the problem associated with the sustain circuit previously described with reference to FIG. 5. Further, FIGS. 8A, 8B, and 8C are diagrams for explaining the relationship of delay time to output pulse width in the prior art sustain circuit, and FIG. 9 is a diagram showing operating waveforms when the output pulse width is large in the prior art sustain circuit.

FIG. 7A shows an essential circuit portion (delay circuit 51 and amplifying circuit 32) for driving one switch device (31); here, the circuit configuration of FIG. 6 is employed for the delay circuit (51) in the sustain circuit shown in FIG. 5. In the circuit of FIG. 7A, Vin(V1) designates the input signal, Vrc the voltage at the connection node between the variable resistor R and the capacitor C in the delay circuit 51, Vth the threshold value of the amplifying circuit 32, and Vo the output voltage of the amplifying circuit. The waveforms of the respective voltages Vin, Vrc, Vth, and Vo are then as shown in FIGS. 7B to 7D. For simplicity, the delay time of the amplifying circuit 32 is assumed to be zero. The above also applies to essential circuit portions constructed with other delay circuits (52, 53, and 54) and amplifying circuits (34, 41, and 38).

First, when the threshold voltage Vth of the amplifying circuit 32 is Vth=Vth1=Vcc/2 where Vcc is the high level "H" voltage of the input signal Vin, the delay time T1 of the front edge (rising edge) through the variable resistor R and capacitor C is equal to the delay time T2 of the back edge (falling edge). Accordingly, the pulse width Twin of the input signal is equal to the pulse width Two of the output signal Vo of the amplifying circuit 32. Even when the delay time T1 is increased by increasing the resistance value of the variable resistor R in the delay circuit 51, the pulse width Two remains constant (see FIG. 8A).

Next, when the threshold voltage Vth is Vth=Vth2<Vcc/2, the output waveform is as shown by a dashed line in FIG. 7D, that is, T1<T2, and hence Twin<Two. In this case, as for the T1 to Two relationship, the pulse width Two of the output signal Vo increases with increasing delay time T1 as shown in FIG. 8B. The waveforms of the respective signals in the sustain circuit shown in FIG. 5 are then as shown by dashed lines in FIG. 9. In FIG. 9, solid lines show the waveforms when Twin=Two.

As a result, as shown in FIG. 9, the time margin TM1 allowed from the time the signal VG2 falls to the time the signal VG1 rises and the time margin TM2 allowed from the time the signal VG1 falls to the time the signal VG2 rises decrease. The time margins TM1 and TM2 are allowed in order to prevent the switch devices 31 (switch device CU) and 33 (CD) from conducting simultaneously and causing a shoot-through current to flow. Decreased time margins would lead to the degradation of circuit reliability.

Furthermore, as shown in FIG. 9, as the time TM3 from the time the signal VG2 falls to the time the signal VG3 rises and the time TM4 from the time the signal VG1 falls to the time the signal VG4 rises also decrease, simultaneous conduction of the switch devices 33 (CD) and 40 (LU) or the switch devices 31 (CU) and 37 (LD) may occur under certain circumstances, causing abnormal current to flow through these switch devices.

When the threshold voltage Vth is vth=Vth3>Vcc/2, the output waveform is as shown by a one-dotted-dash line in FIG. 7D, that is, T1>T2, and hence Twin>Two. In this case, as for the T1 to Two relationship, the pulse width (output pulse width) Two of the output signal Vo decreases with increasing delay time T1 as shown in FIG. 8C. The waveforms of the respective signals in the sustain circuit shown in FIG. 5 are then as shown by the dashed lines in FIG. 9. In FIG. 9, the solid lines show the waveforms when Twin=Two.

Figure 10:
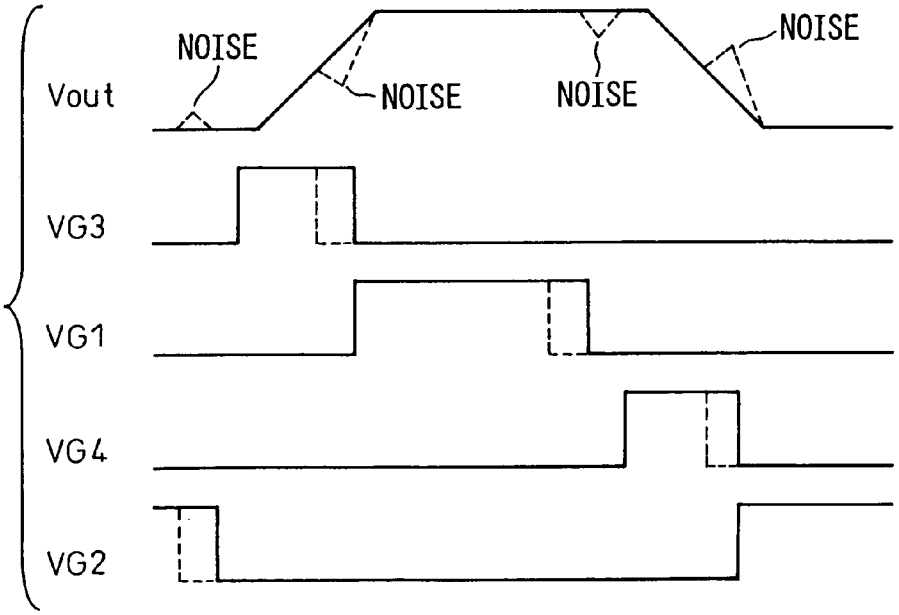
FIG. 10 is a diagram showing operating waveforms when the output pulse width is small in the prior art sustain circuit.

FIG. 10 is a diagram showing the operating waveforms when the output pulse width is small in the prior art sustain circuit.

As shown in FIG. 10, when the pulse widths of the signals VG1 and VG2 are reduced, the ON periods of the switch devices 31 and 33 become shorter. This results in a high impedance state even in a period during which the waveform has to be clamped at the sustain supply voltage Vs or ground potential GND. As a result, noise may be superimposed on the waveform in the high level "H" period or low level "L" period of the sustain voltage (output signal of the sustain circuit).

On the other hand, when the pulse widths of the signals VG3 and VG4 are reduced, there arises the possibility that the switch devices 37 and 40, respectively, may be forced off if the signals VG3 and VG4 rise when the respective switch devices 37 and 40 are conducting. If the switch devices 37 and 40 are forced off, the power loss of the switch devices 37 and 40 may increase, or noise may be superimposed on the rising waveform and falling waveform of the sustain voltage Vout shown in FIG. 10.

If noise occurs due to the high impedance state, or noise is superimposed on the rising waveform and falling waveform of the sustain voltage, the operating margin in the plasma display apparatus decreases, resulting in the occurrence of screen flicker.

In the above description, the delay time of the amplifying circuit has been assumed to be zero, but actually, a delay time also occurs in the amplifying circuit, and the delay time varies due to such factors as variations in the parts of the amplifying circuit. The four delay circuits (51, 52, 53, and 54) shown in FIG. 5 are each constructed to adjust the delay time T1 of the front edge independently of each other, in order to absorb variations in the delay times of the corresponding amplifying circuits (32, 34, 41, and 38); as a result, the characteristic of the pulse width (output pulse width) Two of the output signal Vo is different for each amplifying circuit. This gives rise to another problem that must be solved, because the earlier described problems, such as the reduced time margins, development of abnormal current, etc. that occur when the output pulse width increases, and the superimposition of noise on the sustain voltage Vout that occurs when the output pulse width decreases, become to occur more easily.

Below, embodiments of a capacitive load driving circuit and a plasma display apparatus according to the present invention will be described in detail with reference to the accompanying drawings. It will be appreciated that the display apparatus and its driving method according to the present invention are not limited in application to plasma display apparatuses employing the ALIS method, but can be applied extensively to plasma display apparatuses employing various other methods.

Figure 11:
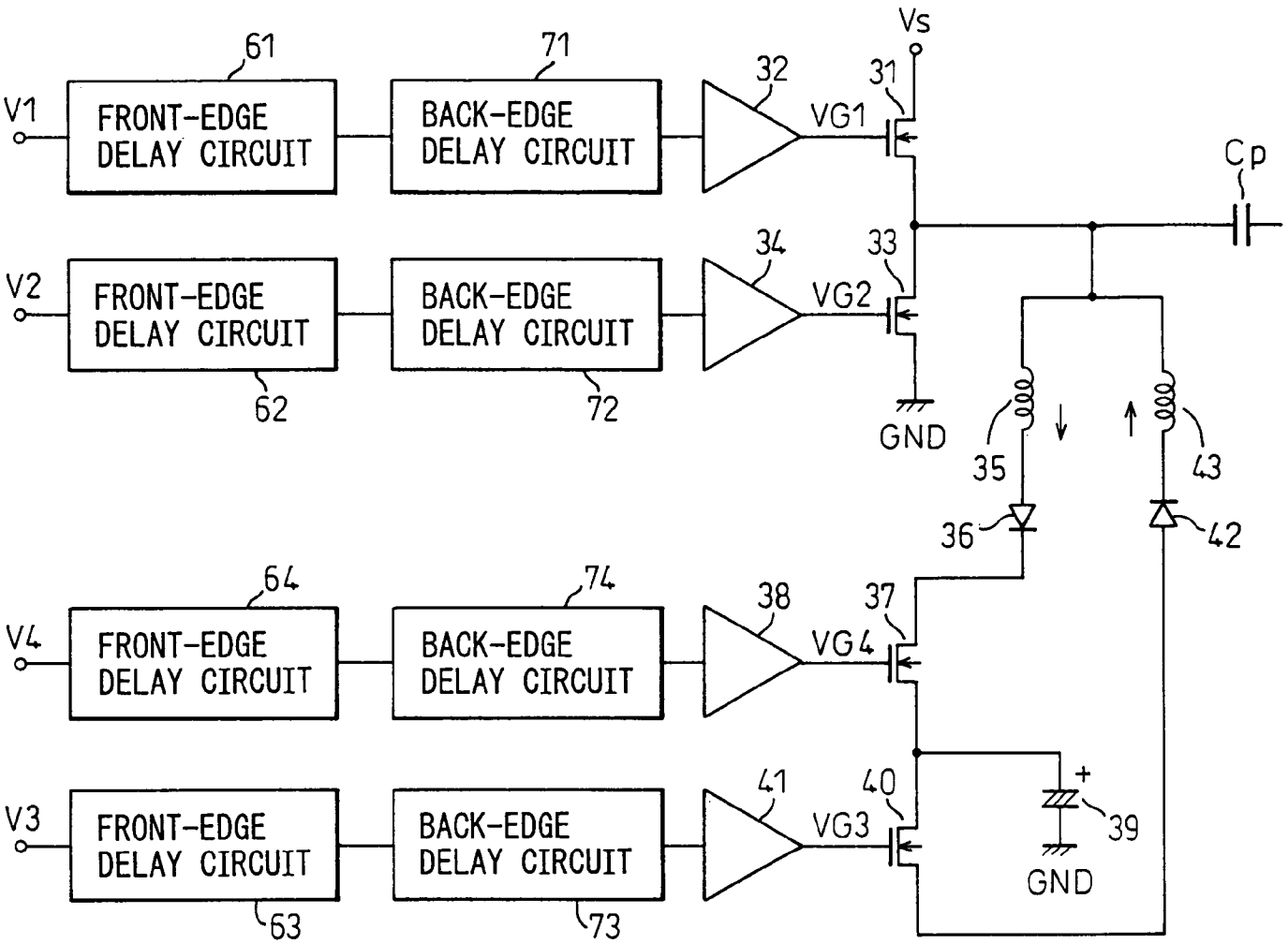
FIG. 11 is a block circuit diagram showing a first embodiment of a capacitive load driving circuit according to the present invention.

FIG. 11 is a block circuit diagram showing a first embodiment of a capacitive load driving circuit according to the present invention.

As is apparent from a comparison between FIG. 11 and FIG. 5, the capacitive load driving circuit of the first embodiment corresponds to a circuit in which the delay circuits 51 to 54 in the prior art sustain circuit (capacitive load driving circuit) shown in FIG. 5 are constructed from front-edge delay circuits 61 to 64 and back-edge delay circuits 71 to 74, respectively. Accordingly, the driving operation of the drive capacitor Cp by the switch devices (sustain output devices: n-channel MOS transistors) 31 and 33 and amplifiers (drive circuits) 32 and 34, the operation of the power recovery circuit by the switch devices 37 and 40, amplifying circuits 38 and 41, diodes 36 and 42, inductances 35 and 43, and capacitor 39 (Cp), etc. are the same as those described in detail with reference to FIG. 5, and the description will not be repeated there.

As shown in FIG. 11, the capacitive load driving circuit of the first embodiment comprises the front-edge delay circuits 61 and 62 for delaying the front edges of the respective input signals V1 and V2, the back-edge delay circuits 71 and 72 for delaying the back edges of the respective input signals V1 and V2, the amplifying circuits 32 and 34 for amplifying the drive control signals obtained through the respective front-edge delay circuits 61 and 62 and back-edge delay circuits 71 and 72, and the switch devices 31 and 33 driven by the respective amplifying circuits 32 and 34.

The capacitive load driving circuit of the first embodiment further comprises the front-edge delay circuits 63 and 64 for delaying the front edges of the respective input signals V3 and V4, the back-edge delay circuits 73 and 74 for delaying the back edges of the respective input signals V3 and V4, the amplifying circuits 41 and 38 for amplifying the drive control signals obtained through the respective front-edge delay circuits 63 and 64 and back-edge delay circuits 73 and 74, and the power recovery circuit which includes the switch devices 40 and 37 driven by the respective amplifying circuits 41 and 38, the diodes 36 and 42, the inductances 35 and 43, and the capacitor 39, as described with reference to FIG. 5.

Figure 12:
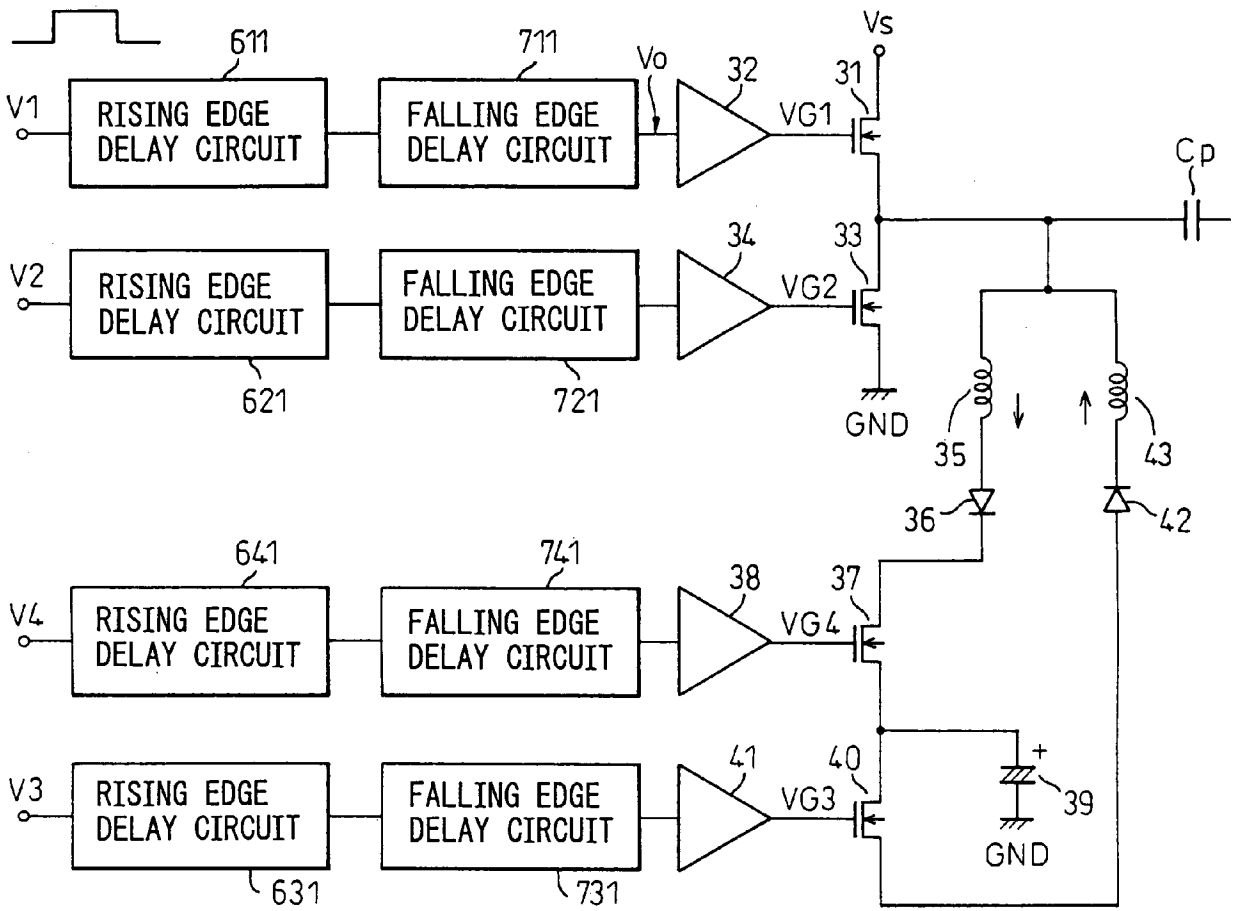
FIG. 12 is a block circuit diagram showing a second embodiment of a capacitive load driving circuit according to the present invention.

FIG. 12 is a block circuit diagram showing a second embodiment of a capacitive load driving circuit according to the present invention.

As is apparent from a comparison between FIG. 12 and FIG. 11, the capacitive load driving circuit of the second embodiment is a circuit in which the front-edge delay circuits 61 to 64 and the back-edge delay circuits 71 to 74 in the capacitive load driving circuit of the first embodiment are constructed respectively as rising edge delay circuits 611 to 641 for delaying the rising edges of the respective input signals V1 to V4 and falling edge delay circuits 711 to 741 for delaying the falling edges of the respective input signals V1 to V4. Here, the input signals V1 to V4 are each a positive polarity pulse signal (high enable signal) which is active at a high level "H".

Figure 13:
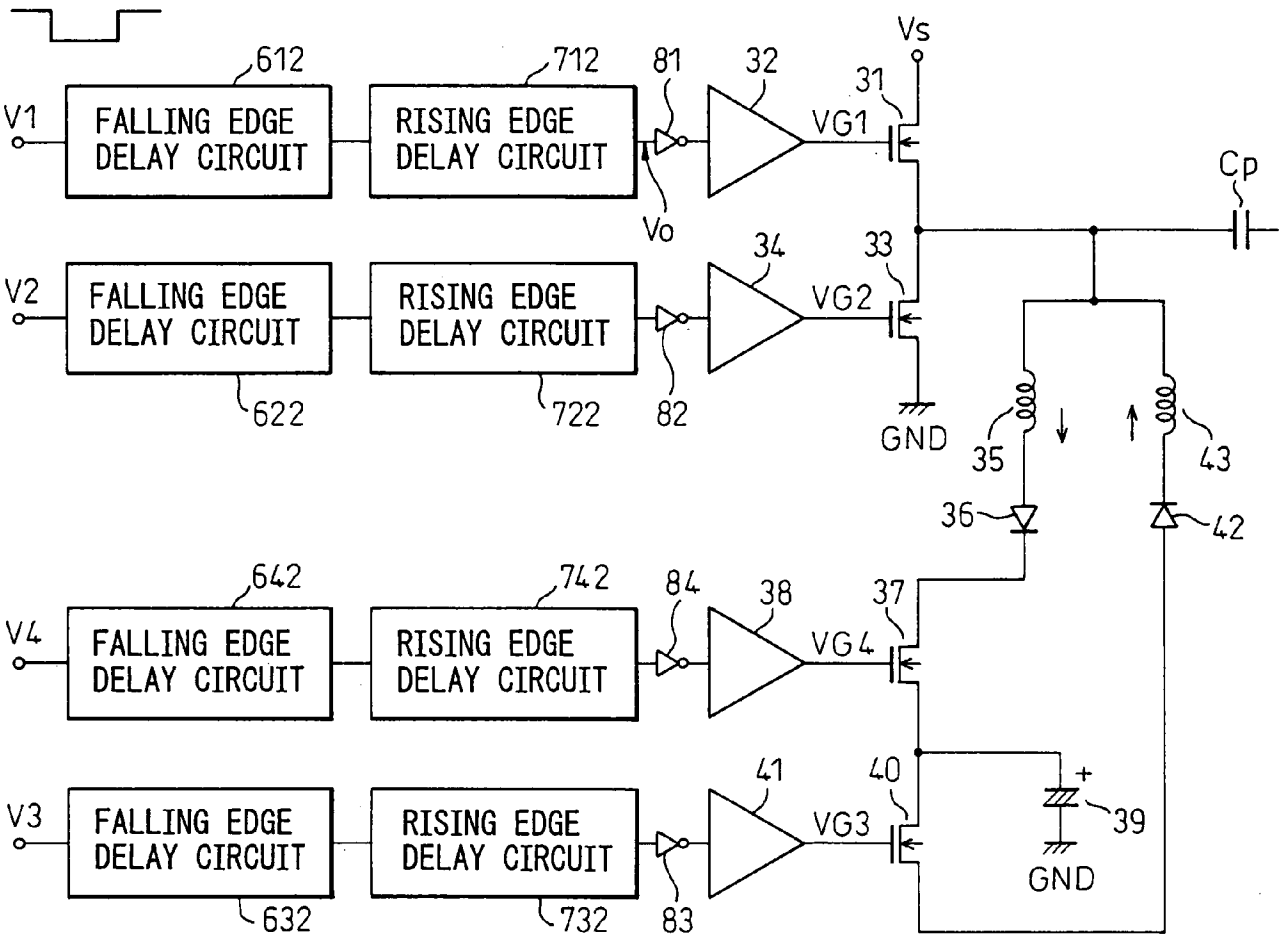
FIG. 13 is a block circuit diagram showing a third embodiment of a capacitive load driving circuit according to the present invention.

FIG. 13 is a block circuit diagram showing a third embodiment of a capacitive load driving circuit according to the present invention.

As is apparent from a comparison between FIG. 13 and FIG. 11, the capacitive load driving circuit of the third embodiment is a circuit in which the front-edge delay circuits 61 to 64 and the back-edge delay circuits 71 to 74 in the capacitive load driving circuit of the first embodiment are constructed respectively as falling edge delay circuits 612 to 642 for delaying the falling edges of the respective input signals V1 to V4 and rising edge delay circuits 712 to 742 for delaying the rising edges of the respective input signals V1 to V4. Here, the input signals V1 to V4 are each a negative polarity pulse signal (low enable signal) which is active at a low level "L". Output signals from the rising edge delay circuits 712 to 742 are supplied to the corresponding switch devices (31, 33, 40, and 37) via inverters 81 to 84, respectively.

Figure 14:
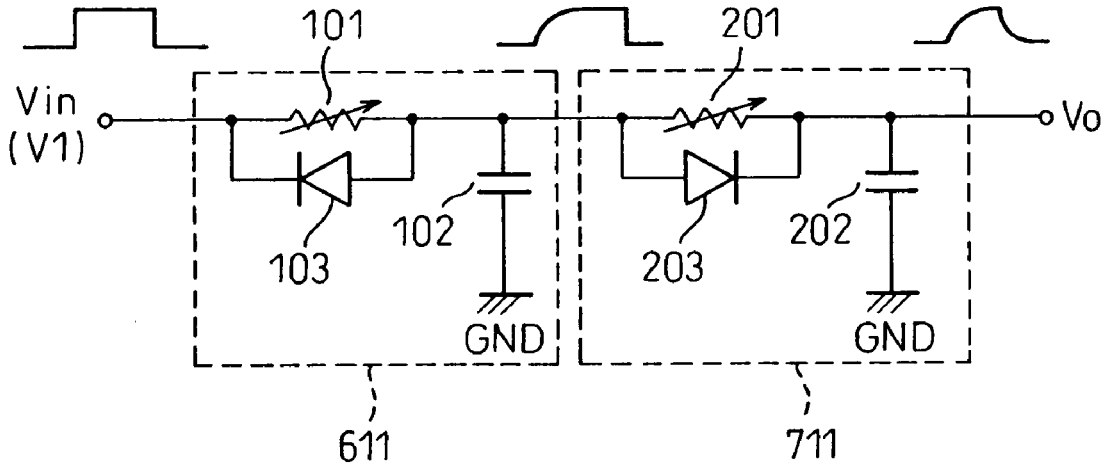
FIG. 14 is a circuit diagram showing an essential portion of a fourth embodiment of a capacitive load driving circuit according to the present invention.

FIG. 14 is a circuit diagram showing an essential portion of a fourth embodiment of a capacitive load driving circuit according to the present invention; shown here is one specific example of the circuit configuration of the rising edge delay circuit 611 (621 to 641) and falling edge delay circuit 711 (721 to 741) in the capacitive load driving circuit of the second embodiment shown in FIG. 12.

As shown in FIG. 14, the rising edge delay circuit 611 comprises a variable resistor (variable resistive element) 101, a capacitor (capacitive element) 102, and a diode 103, while the falling edge delay circuit 711 comprises a variable resistor 201, a capacitor 202, and a diode 203. In the rising edge delay circuit 611, the variable resistor 101 is connected in parallel to the diode 103 directed in the reverse direction with respect to the input signal Vin (V1), and one end of the capacitor 102, whose other end is connected to ground GND, is connected to the output-side connection node between the variable resistor 101 and the diode 103. On the other hand, in the falling edge delay circuit 711, the variable resistor 201 is connected in parallel to the diode 203 directed in the forward direction with respect to the input signal Vin, and one end of the capacitor 202, whose other end is connected to ground GND, is connected to the output-side connection node between the variable resistor 201 and the diode 203. Here, a positive polarity pulse signal is used as the input signal Vin.

In the capacitive load driving circuit of the fourth embodiment shown in FIG. 14, first, the rising edge of the input signal Vin is delayed by an integrating circuit comprising the variable resistor 101 and capacitor 102 in the rising edge delay circuit 611. Here, when the input signal Vin falls, the charge stored in the capacitor 102 is discharged through the diode 103, so that the falling edge of the input signal Vin is transferred to the falling edge delay circuit 711 at the next stage without being affected by the variable resistor 101. The rising edge delay circuit 611 thus acts to delay the rising edge of the input signal Vin, and can adjust the delay time of only the rising edge independently by varying the resistance value of the variable resistor 101.

The output signal of the rising edge delay circuit 611 is supplied to the falling edge delay circuit 711 where the falling edge of the output signal (input signal V1: Vin) of the rising edge delay circuit 611 is delayed by an integrating circuit comprising the variable resistor 201 and capacitor 202. Here, when the output signal of the rising edge delay circuit 611 rises, the capacitor 202 is discharged through the diode 203. The falling edge delay circuit 711 thus acts to delay the falling edge of the output signal of the rising edge delay circuit 611, and can adjust the delay time of only the falling edge independently by varying the resistance value of the variable resistor 201. The output signal of the falling edge delay circuit 711 is supplied to the amplifying circuit 32 which drives the switch device 31.

As described above, according to the capacitive load driving circuit of the fourth embodiment, the rising edge and the falling edge of the input signal Vin (V1 to V4) can be adjusted independently of each other and, as a result, a proper output voltage can be supplied to the capacitive load by reducing the variation of the output signal pulse width.

Figure 15:
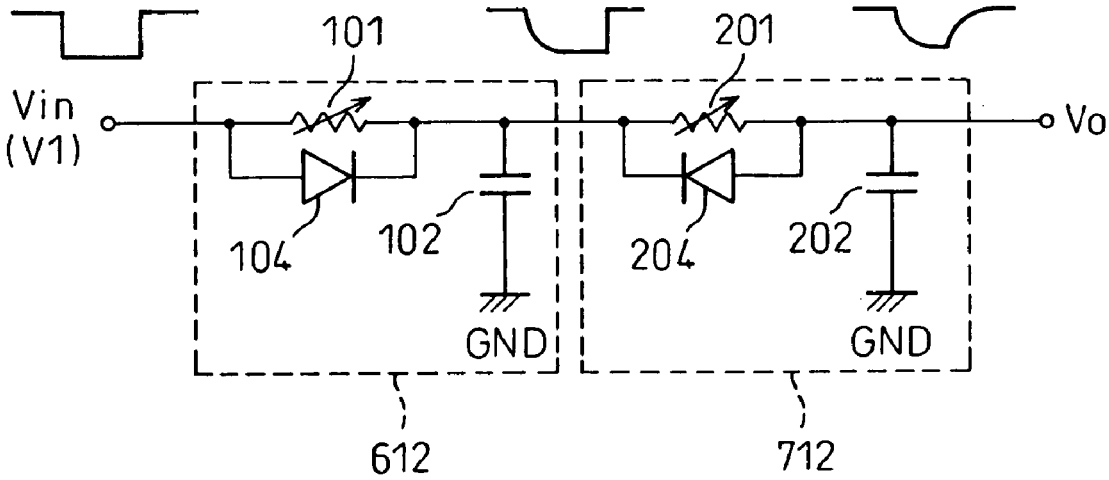
FIG. 15 is a circuit diagram showing an essential portion of a fifth embodiment of a capacitive load driving circuit according to the present invention.

FIG. 15 is a circuit diagram showing an essential portion of a fifth embodiment of a capacitive load driving circuit according to the present invention; shown here is one specific example of the circuit configuration of the falling edge delay circuit 612 (622 to 642) and rising edge delay circuit 712 (722 to 742) in the capacitive load driving circuit of the third embodiment shown in FIG. 13.

As is apparent from a comparison between FIG. 15 and FIG. 14, in the capacitive load driving circuit of the fifth embodiment, the rising edge delay circuit 611 and the falling edge delay circuit 711 in the fourth embodiment are configured as the falling edge delay circuit 612 and the rising edge delay circuit 712, respectively, by replacing the diodes 103 and 203 in the fourth embodiment shown in FIG. 14 by diodes 104 and 204 whose polarities are reversed from the diodes 103 and 203. Here, a negative polarity pulse signal is used as the input signal Vin (V1). The output signal of the rising edge delay circuit 712 is supplied via an inverter (81) to the amplifying circuit 32 which drives the switch device 31.

Figure 16A:
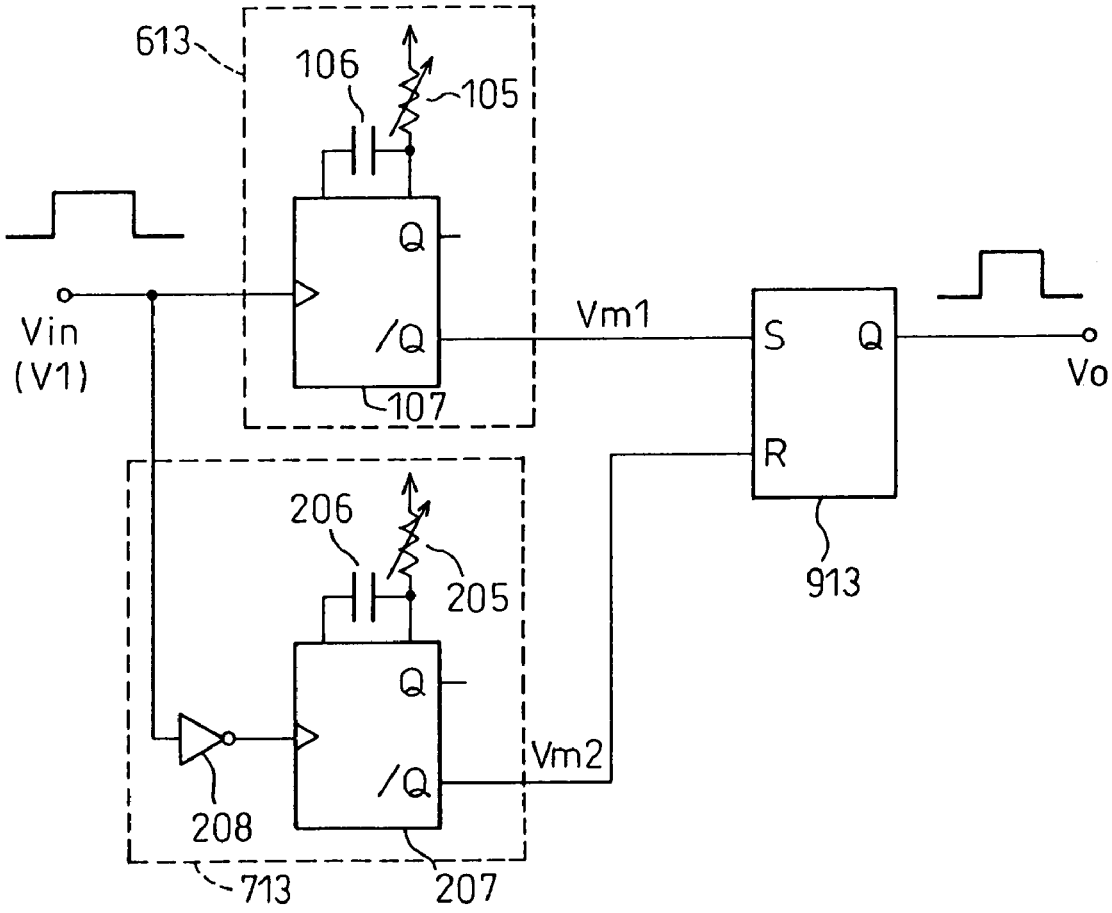
FIGS. 16A and 16B are diagrams showing a sixth embodiment of a capacitive load driving circuit according to the present invention.
Figure 16B:
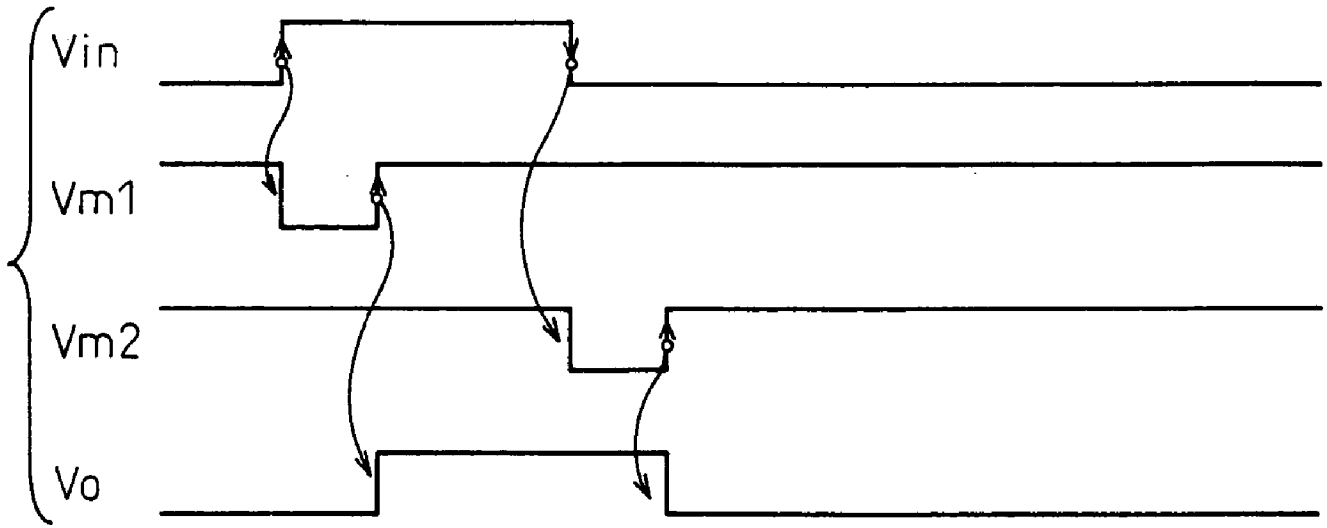

FIGS. 16A and 16B are diagrams showing a sixth embodiment of a capacitive load driving circuit according to the present invention: FIG. 16A is a circuit diagram showing an essential portion, and FIG. 16B is a waveform diagram for the circuit of FIG. 16A. In FIG. 16A, reference numeral 613 is a front-edge delay circuit (rising edge delay circuit), 713 is a back-edge delay circuit (falling edge delay circuit), 107 and 207 are first and second monostable multivibrators, respectively, and 913 is an S-R flip-flop. Here, a positive polarity pulse signal is used as the input signal Vin.

As shown in FIG. 16A, the front-edge delay circuit 613 comprises a variable resistor 105, a capacitor 106, and the first monostable multivibrator 107, while the back-edge delay circuit 713 comprises a variable resistor 205, a capacitor 206, the second monostable multivibrator 207, and an inverter 208. The input signal Vin (V1) is supplied to the first monostable multivibrator 107, and also to the second monostable multivibrator 207 via the inverter 208. The first monostable multivibrator 107, which is provided with the variable resistor 105 and the capacitor 106, delays the rising edge of the input signal Vin by adjusting the resistance value of the variable resistor 105 and thereby varying the time constant. On the other hand, the second monostable multivibrator 207, which is provided with the variable resistor 205 and the capacitor 206, delays the rising edge of the input signal (/Vin) inverted by the inverter 208, that is, the falling edge of the input signal Vin, by adjusting the resistance value of the variable resistor 205 and thereby varying the time constant.

An output signal (/Q output) Vm1 from the first monostable multivibrator 107 and an output signal (/Q output) Vm2 from the second monostable multivibrator 207 are supplied to the set terminal S and the reset terminal R, respectively, of the S-R flip-flop 913 which produces an output signal Vo such as shown in FIG. 16B. More specifically, the output signal Vm1 of the first monostable multivibrator 107 falls with the rising edge of the input signal Vin, and rises after a predetermined time defined by the time constant of the variable resistor 105 and capacitor 106. On the other hand, the output signal Vm2 of the second monostable multivibrator 207 falls with the falling edge of the input signal Vin, and rises after a predetermined time defined by the time constant of the variable resistor 205 and capacitor 206. Here, it is assumed that the delay times of the first and second monostable multivibrators 107 and 207 and the delay time of the inverter 208 are negligibly small.

Further, as shown in FIGS. 16A and 16B, as the S-R flip-flop 913 is set by the rising edge of the signal Vm1 and reset by the rising edge of the signal Vm2, the output signal Vo is a pulse voltage that rises with the rising edge of the signal Vm1 and falls with the rising edge of the signal Vm2.

In this way, in the capacitive load driving circuit of the sixth embodiment, the rising edge of the output signal Vo is formed by delaying the rising edge of the input signal Vin, and the falling edge of the output signal Vo is formed by delaying the falling edge of the input signal Vin. The delay time of the rising edge can be adjusted by varying the resistance value of the variable resistor 105, while the delay time of the falling edge can be adjusted by varying the resistance value of the variable resistor 205. Alternatively, the capacitors 106 and 206 may be constructed from variable capacitors, and the delay times may be adjusted by varying their capacitance values instead of, or in addition to, varying the resistance values of the variable resistors 105 and 205.

As described above, according to the first to sixth embodiments of the capacitive load driving circuit of the present invention, the delay time of the front edge (rising edge or falling edge) of the input signal and the delay time of the back edge (falling edge or rising edge) can be set independently of each other, and this serves to reduce the variation in output pulse width (variation in the pulse width of the drive pulse to be supplied to the switch device) that usually occurs when the delay time of the front edge is varied. As a result, a proper output voltage can be supplied to each capacitive load and, when the capacitive load driving circuit is applied to the plasma display apparatus, drive voltages free from such problems as reduced time margin, occurrence of abnormal current, superimposition of noise, etc., can be supplied to the plasma display panel.

Figure 17:
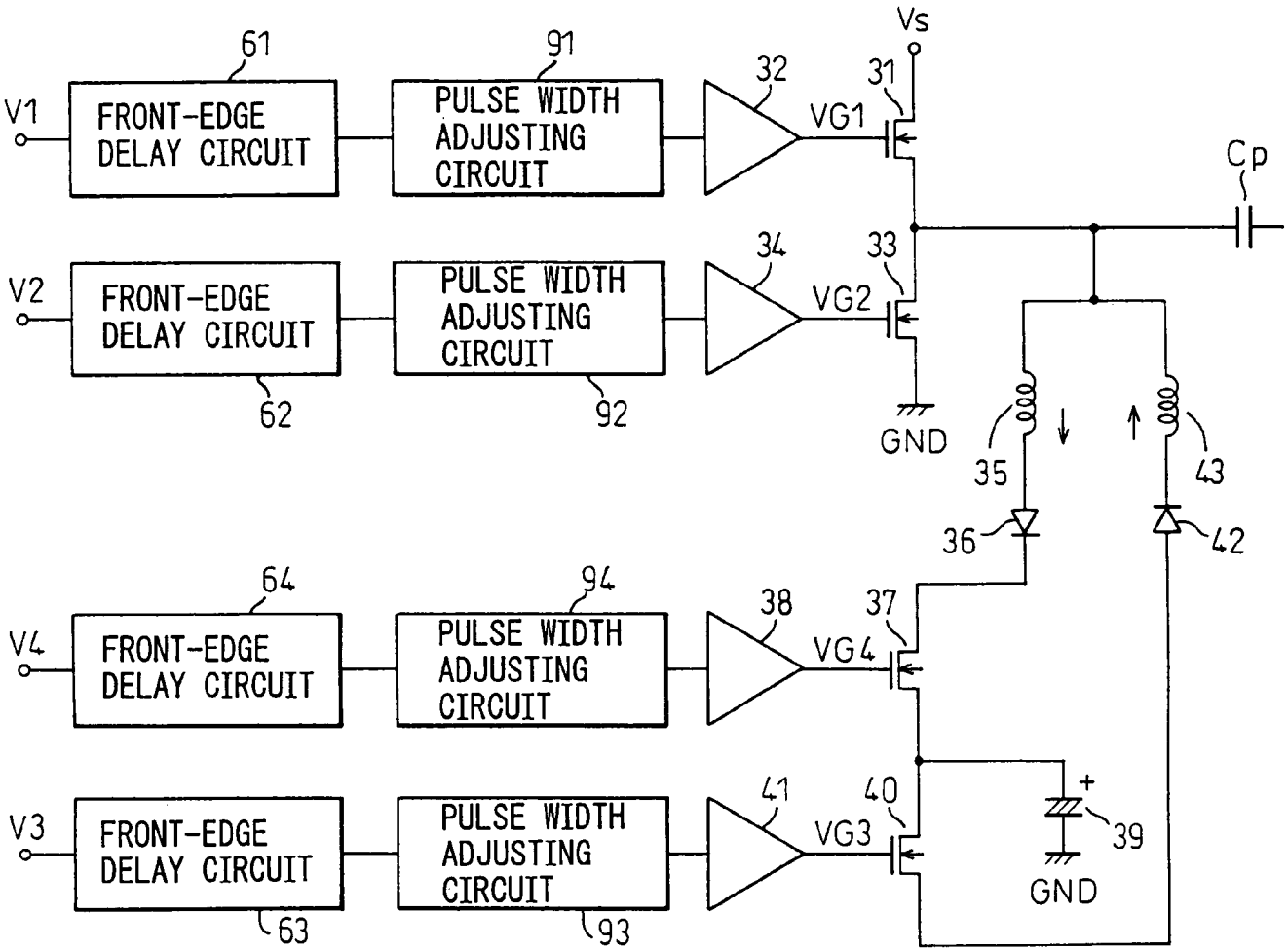
FIG. 17 is a block circuit diagram showing a seventh embodiment of a capacitive load driving circuit according to the present invention.

FIG. 17 is a block circuit diagram showing a seventh embodiment of a capacitive load driving circuit according to the present invention.

As shown in FIG. 17, the capacitive load driving circuit of the seventh embodiment comprises front-edge delay circuits 61 to 64 and pulse width adjusting circuits 91 to 94. That is, the capacitive load driving circuit of the seventh embodiment uses the pulse width adjusting circuits 91 to 94 in place of the back-edge delay circuits 71 to 74 used in the first embodiment described with reference to FIG. 11.

Figure 18A:
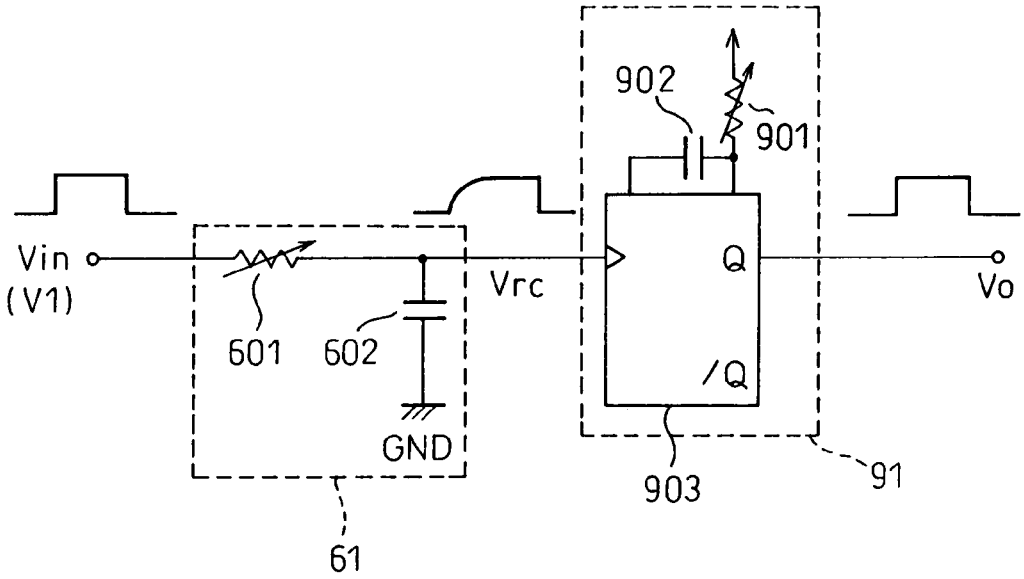
FIGS. 18A and 18B are diagrams showing an eighth embodiment of a capacitive load driving circuit according to the present invention.
Figure 18B:
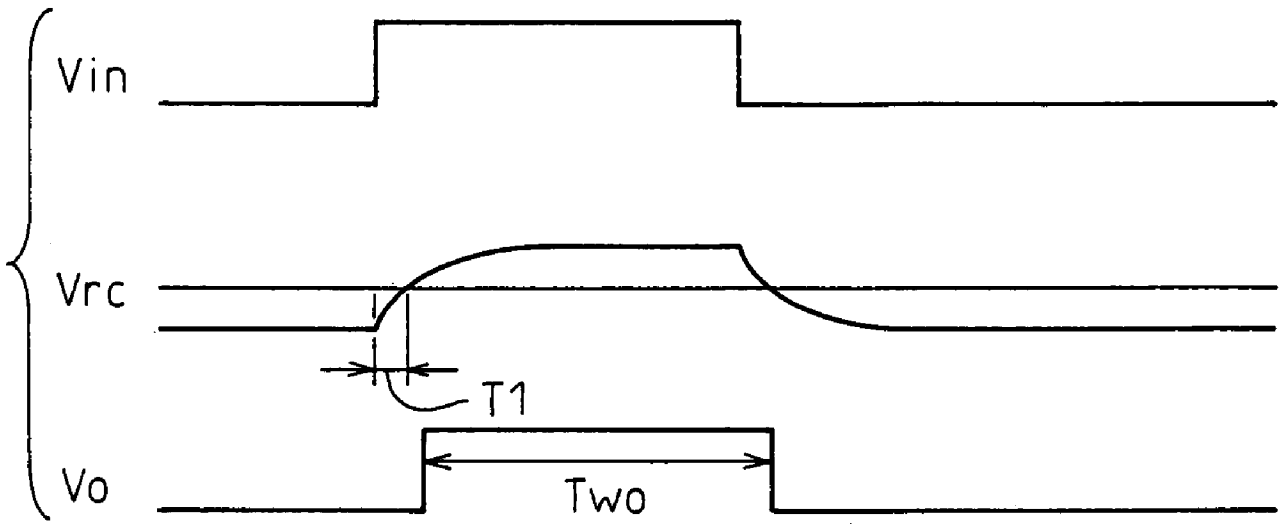

FIGS. 18A and 18B are diagrams showing an eighth embodiment of a capacitive load driving circuit according to the present invention: FIG. 18A is a circuit diagram showing an essential portion, and FIG. 18B is a waveform diagram for the circuit of FIG. 18A. The circuit shown in FIG. 18A is one specific example of the circuit configuration of the front-edge delay circuit 61 (62 to 64) and pulse width adjusting circuit 91 (92 to 94) in the capacitive load driving circuit of the foregoing seventh embodiment shown in FIG. 17.

As shown in FIG. 18A, the front-edge delay circuit 61 comprises a variable resistor 601 and a capacitor 602, and the pulse width adjusting circuit 91 comprises a variable resistor 901, a capacitor 902, and a monostable multivibrator 903. That is, as shown in FIG. 18B, in the capacitive load driving circuit of the eighth embodiment, the front edge of the input signal Vin is delayed (delay time T1) by the front-edge delay circuit 61 having a configuration similar to that of the delay circuit 51 in the prior art sustain circuit described with reference to FIG. 7A, and an output voltage Vo having a pulse width Two defined by the time constant of the variable resistor 901 and capacitor 902 is obtained from the monostable multivibrator 903. More specifically, the capacitive load driving circuit of the eighth embodiment is configured so that the delay time of the front edge and the pulse width of the output signal can be set independently of each other by adjusting the delay time T1 of the front edge of the input signal Vin by varying the resistance value of the variable resistor 601 in the front-edge delay circuit 61, and by adjusting the pulse width Two of the output signal Vo by varying the resistance value of the variable resistor 901 in the pulse width adjusting circuit 91.

Figure 19A:
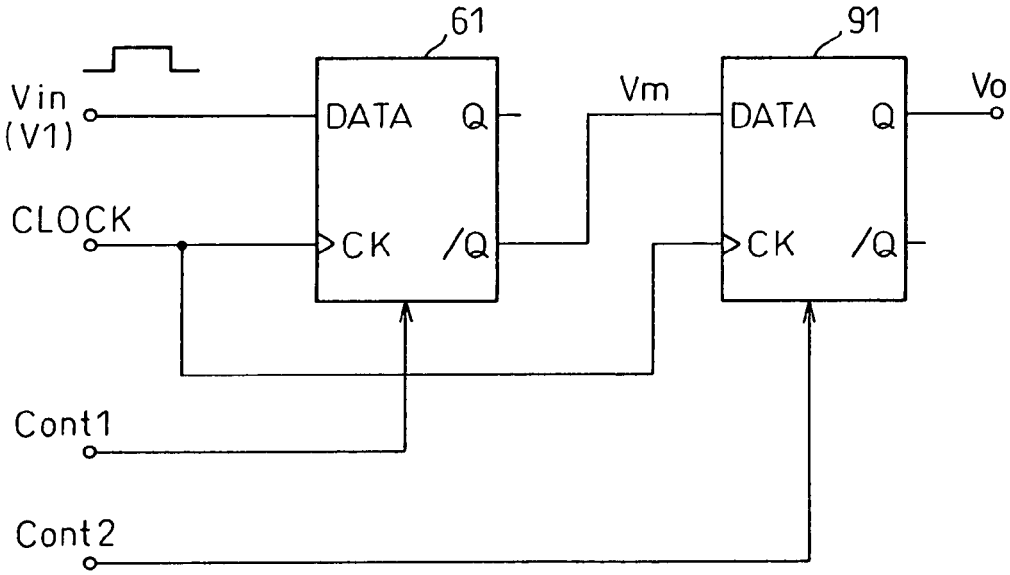
FIGS. 19A and 19B are diagrams showing a ninth embodiment of a capacitive load driving circuit according to the present invention.
Figure 19B:
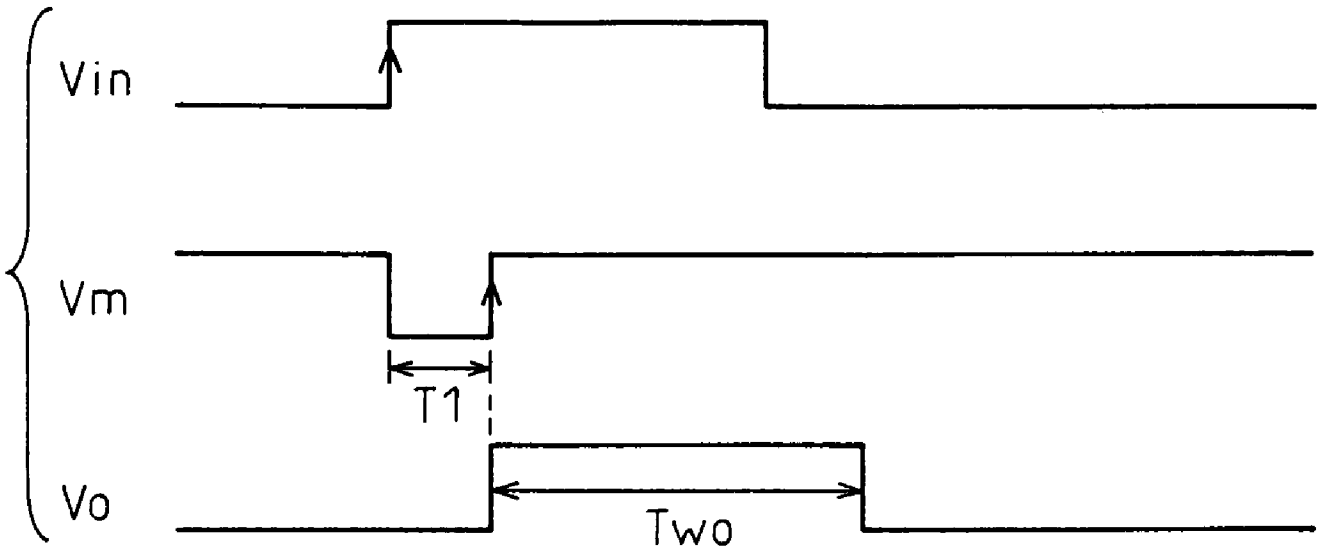

FIGS. 19A and 19B are diagrams showing a ninth embodiment of a capacitive load driving circuit according to the present invention: FIG. 19A is a circuit diagram showing an essential portion, and FIG. 19B is a waveform diagram for the circuit of FIG. 19A. The circuit shown in FIG. 19A is another specific example of the circuit configuration of the front-edge delay circuit 61 (62 to 64) and pulse width adjusting circuit 91 (92 to 94) in the capacitive load driving circuit of the foregoing eighth embodiment shown in FIG. 18A.

As shown in FIG. 19A, in the capacitive load driving circuit of the ninth embodiment, the front-edge delay circuit 61 and the pulse width adjusting circuit 91 are each configured as a counter for counting the number of pulses in a clock signal CLOCK, and the delay time T1 of the front edge of the input signal Vin is adjusted by varying the count number (Cont1) set in the counter 61, while the pulse width Two of the output signal Vo is adjusted by varying the count number (Cont2) set in the counter 91. The capacitive load driving circuit of the ninth embodiment is configured so that the delay time of the front edge and the pulse width of the output signal can be adjusted easily and independently of each other by the signals Cont1 and Cont2 supplied to the respective counters 61 and 91.

As described above, according to the seventh to ninth embodiments of the capacitive load driving circuit of the present invention, the delay time of the front edge (rising edge or falling edge) of the input signal and the pulse width of the output signal can be set independently of each other, and this serves to reduce the variation in output pulse width that usually occurs when the delay time of the front edge is varied. As a result, a proper output voltage can be supplied to each capacitive load and, when the capacitive load driving circuit is applied to the plasma display apparatus, drive voltages free from such problems as reduced time margin, occurrence of abnormal current, superimposition of noise, etc., can be supplied to the plasma display panel.

Figure 20:
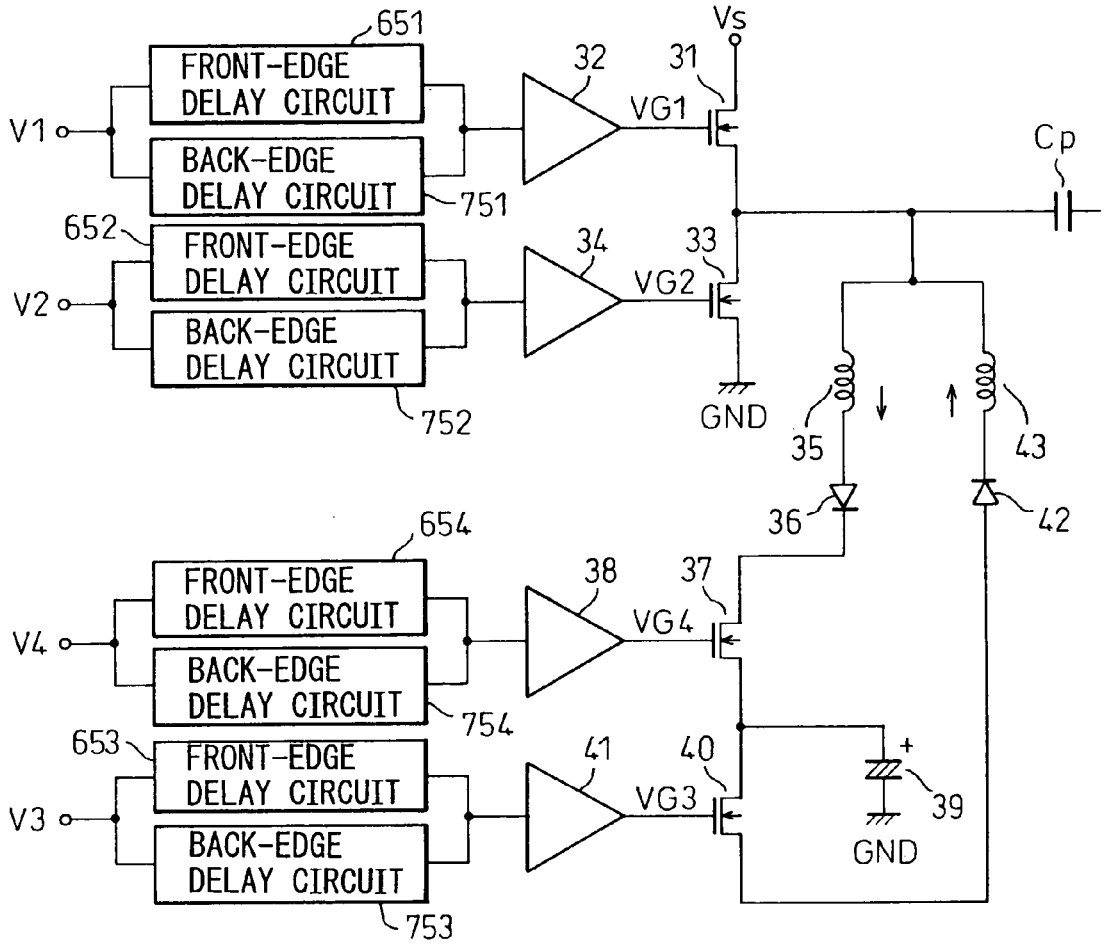
FIG. 20 is a block circuit diagram showing a 10th embodiment of a capacitive load driving circuit according to the present invention.

FIG. 20 is a block circuit diagram showing a 10th embodiment of a capacitive load driving circuit according to the present invention.

As is apparent from a comparison between FIG. 20 and FIG. 11, the capacitive load driving circuit of the 10th embodiment differs from the first embodiment shown in FIG. 11 in that the front-edge delay circuit (61) and the back-edge delay circuit (71), which were connected in series between the input terminal (for example, V1) and the amplifying circuit (for example, 32) in the first embodiment, are arranged in parallel to each other.

That is, as shown in FIG. 20, the input signals V1 to V4 are supplied to the front-edge delay circuits 651 to 654 and back-edge delay circuits 751 to 754, respectively, and the outputs from the front-edge delay circuits 651, 652, 653, and 654 and back-edge delay circuits 751, 752, 753, and 754 are supplied to the respective amplifier circuits 32, 34, 41, and 38.

Figure 21:
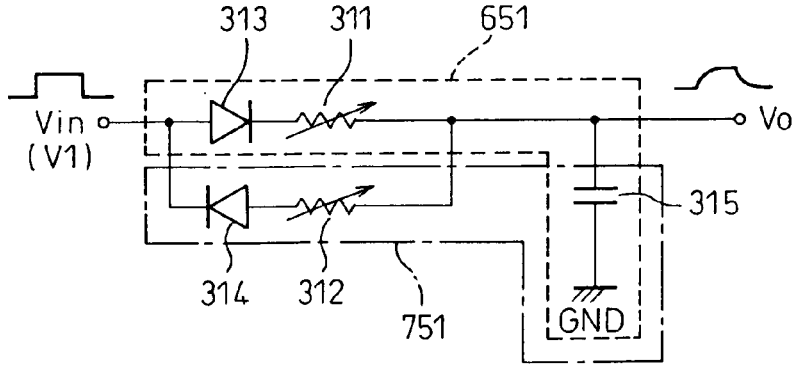
FIG. 21 is a circuit diagram showing an essential portion of an 11th embodiment of a capacitive load driving circuit according to the present invention.

FIG. 21 is a circuit diagram showing an essential portion of an 11th embodiment of a capacitive load driving circuit according to the present invention; shown here is one specific example of the circuit configuration of the front-edge delay circuit 651 (652 to 654) and back-edge delay circuit 751 (752 to 754) in the capacitive load driving circuit of the 10th embodiment shown in FIG. 20.

As shown in FIG. 21, in the capacitive load driving circuit of the 11th embodiment, the front-edge delay circuit (rising edge delay circuit) 651 comprises a variable resistor 311, a diode 313, and a capacitor 315, while the back-edge delay circuit (falling edge delay circuit) 751 comprises a variable resistor 312, a diode 314, and the capacitor 315. That is, in the capacitive load driving circuit of the 11th embodiment, the capacitor 315 is shared between the front-edge delay circuit 651 and the back-edge delay circuit 751. Here, the delay time of the front edge (rising edge) of the input signal Vin is adjusted by varying the resistance value of the variable resistor 311, and the delay time of the back edge (falling edge) is adjusted by varying the resistance value of the variable resistor 312.

Figure 22:
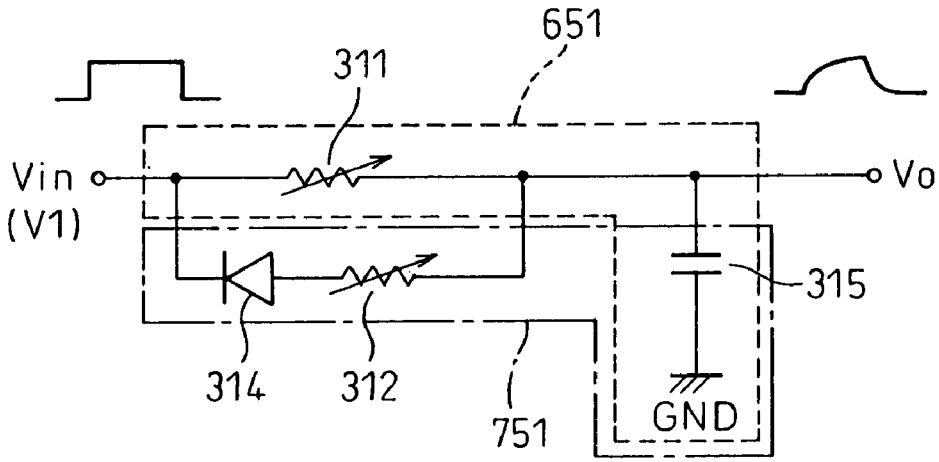
FIG. 22 is a circuit diagram showing an essential portion of a 12th embodiment of a capacitive load driving circuit according to the present invention.

FIG. 22 is a circuit diagram showing an essential portion of a 12th embodiment of a capacitive load driving circuit according to the present invention; shown here is another specific example of the circuit configuration of the front-edge delay circuit 651 (652 to 654) and back-edge delay circuit 751 (752 to 754) in the capacitive load driving circuit of the 10th embodiment shown in FIG. 20. In the capacitive load driving circuit of the 12th embodiment shown in FIG. 22, a positive polarity pulse signal is used as the input signal Vin, and the front-edge delay circuit 651 delays the rising edge of the input signal Vin, while the back-edge delay circuit 751 delays the falling edge.

As is apparent from a comparison between FIG. 22 and FIG. 21, the front-edge delay circuit (rising edge delay circuit) 651 in the capacitive load driving circuit of the 12th embodiment differs from the front-edge delay circuit in the capacitive load driving circuit of the foregoing 11th embodiment in that the diode 313 is omitted from the front-edge delay circuit. When the input signal Vin rises, the capacitor 315 is charged through the variable resistor 311 and, when the input signal Vin falls, the capacitor 315 is discharged through the variable resistor 311 and also through the variable resistor 312 connected in series with the diode 314. That is, the delay time of the rising edge of the output voltage Vo changes with the resistance value of the variable resistor 311 and, the delay time of the falling edge of the output voltage Vo changes with the resistance values of the variable resistors 311 and 312.

Accordingly, in the capacitive load driving circuit of the 12th embodiment, the delay time of the rising edge and the delay time of the falling edge can be adjusted properly, first by adjusting the delay time of the rising edge by varying the resistance value of the variable resistor 311 in the front-edge delay circuit 651, and then by adjusting the delay time of the falling edge by varying the resistance value of the variable resistor 312 in the back-edge delay circuit 751.

Figure 23:
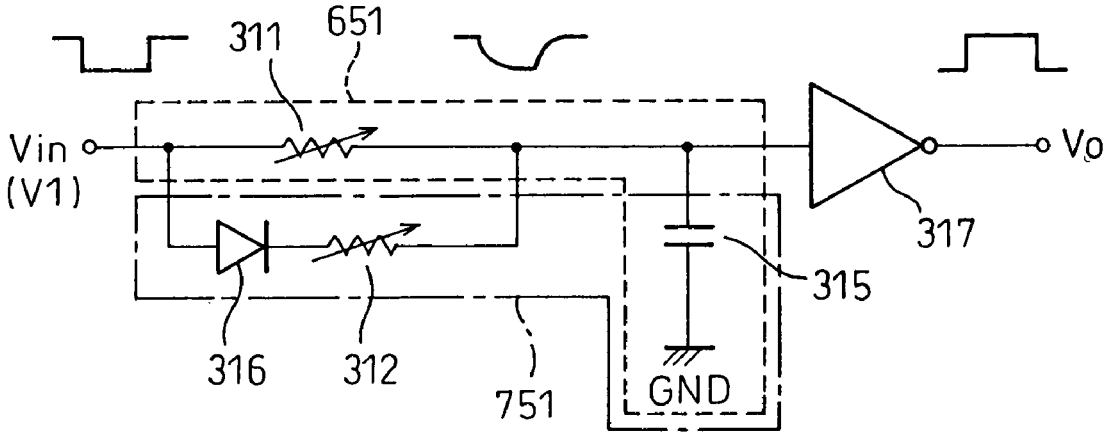
FIG. 23 is a circuit diagram showing an essential portion of a 13th embodiment of a capacitive load driving circuit according to the present invention.

FIG. 23 is a circuit diagram showing an essential portion of a 13th embodiment of a capacitive load driving circuit according to the present invention. In the capacitive load driving circuit of the 13th embodiment, a negative polarity pulse signal is used as the input signal Vin, and the front-edge delay circuit 651 delays the falling edge of the input signal Vin, while the back-edge delay circuit 751 delays the rising edge. In the 13th embodiment, the signal produced by adjusting the delay times of the front and back edges of the input signal Vin is inverted and waveshaped by the inverter 317, and the resulting output signal Vo is supplied to the amplifying circuit 32 at the next stage.

As is apparent from a comparison between FIG. 23 and FIG. 22, the back-edge delay circuit (rising edge delay circuit) 751 in the capacitive load driving circuit of the 13th embodiment differs from the back-edge delay circuit (falling edge delay circuit) in the capacitive load driving circuit of the foregoing 12th embodiment in that the direction of the diode is reversed. When the input signal Vin falls, the capacitor 315 is discharged through the variable resistor 311, and when the input signal Vin rises, the capacitor 315 is charged through the variable resistor 311 and also through the variable resistor 312 connected in series with the diode 316. That is, the delay time of the falling edge of the output voltage Vo changes with the resistance value of the variable resistor 311, and the delay time of the rising edge of the output voltage Vo changes with the resistance values of the variable resistors 311 and 312.

Accordingly, in the capacitive load driving circuit of the 13th embodiment, the delay time of the falling edge and the delay time of the rising edge can be adjusted properly, first by adjusting the delay time of the falling edge by varying the resistance value of the variable resistor 311 in the front-edge delay circuit 651, and then by adjusting the delay time of the rising edge by varying the resistance value of the variable resistor 312 in the back-edge delay circuit 751.

Figure 24:
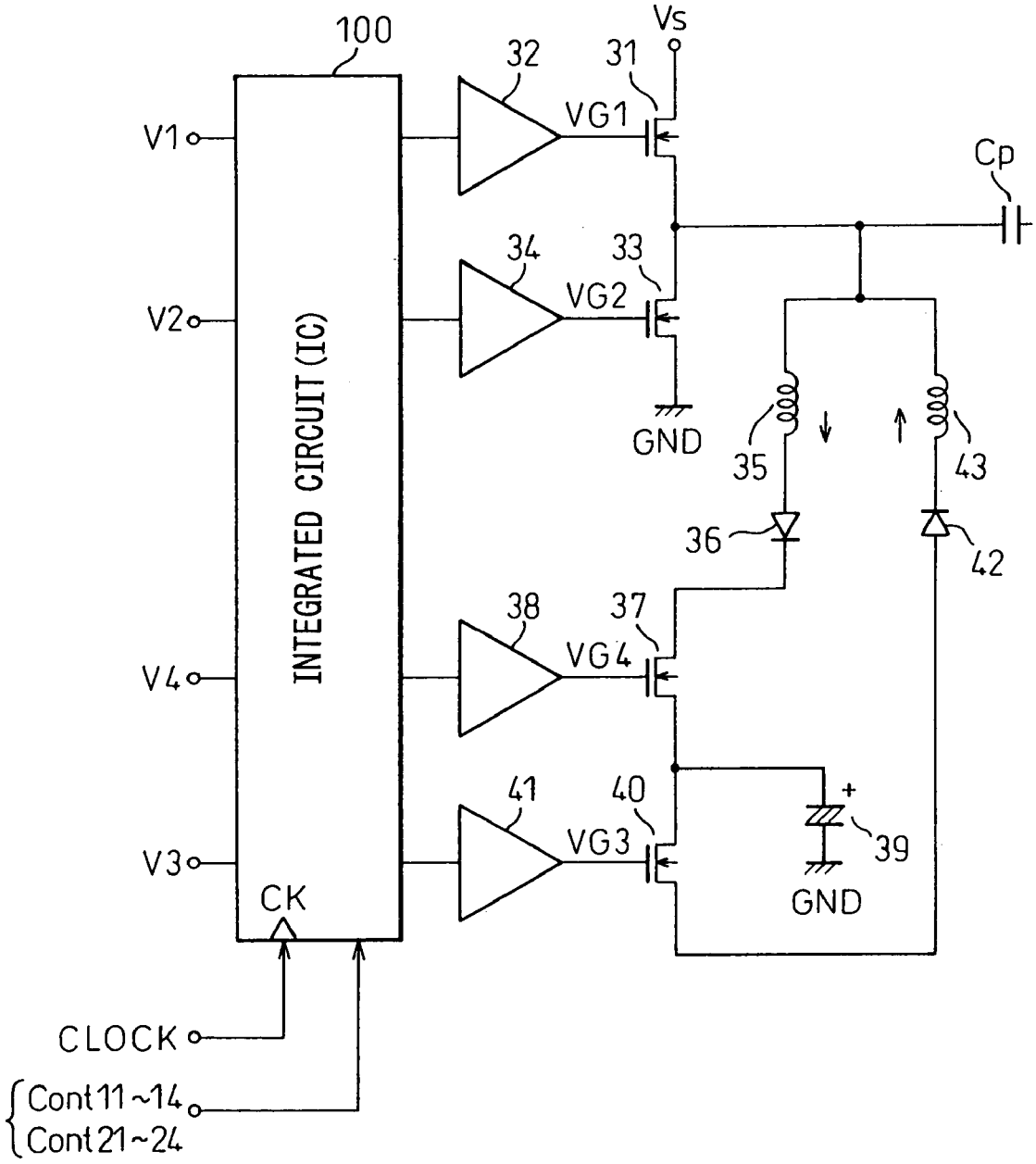
FIG. 24 is a block circuit diagram showing a 14th embodiment of a capacitive load driving circuit according to the present invention.

FIG. 24 is a block circuit diagram showing a 14th embodiment of a capacitive load driving circuit according to the present invention, in which the front-edge delay circuits (61 to 64) and the pulse width adjusting circuits (91 to 94) in the ninth embodiment previously described with reference to FIGS. 19A and 19B are together constructed as an integrated circuit 100.

As shown in FIG. 24, the integrated circuit 100 receives, for example, the input signals V1 to V4 and clock signal CLOCK and, by counting the clock signal CLOCK up to the numbers defined by the respective control signals (Cont11 to Cont14 and Cont21 to Cont24), adjusts the delay times of the front edges of the respective input signals in the respective front-edge delay circuits, while adjusting the pulse widths of the respective input signals in the respective pulse width adjusting circuits. Then, the signals produced by adjusting the front edge delay times and the pulse widths are supplied to the respectively corresponding amplifying circuits 32, 34, 41, and 38, to perform the driving of the switch devices (sustain output devices) and the recovery of power in the same manner as described with reference to FIG. 5.

More specifically, the front-edge delay circuits (counters 61 to 64) are supplied with the respective control signals (count numbers) Cont11 to Cont14 for adjusting the front edge delay times (T1) of the respective input signals (V1 to V4), while the pulse width adjusting circuits (counters 91 to 94) are supplied with the respective control signals (count numbers) Cont21 to Cont24 for adjusting the pulse widths (Two) of the respective output signals. That is, according to the 14th embodiment, the delay times of the front edges and the pulse widths of the respective output signals can be adjusted easily and independently of each other by the signals (Cont11 to Cont14 and Cont21 to Cont24) supplied to the respective counters (61 to 64 and 91 to 94).

The above embodiments have only shown examples of the front-edge delay circuit, the back-edge delay circuit, the pulse width adjusting circuit, etc., and it will be appreciated that various modifications can be made to these circuits.

In this way, each of the above embodiments of the capacitive load driving circuit, when applied as the sustain circuit in the plasma display apparatus such as described with reference to FIGS. 1 to 4B, can solve the various problems, such as the reduction of time margin and the occurrence of abnormal current and noise, that can occur when the delay time in the sustain circuit is adjusted.

As described in detail above, according to the present invention, it becomes possible to provide a capacitive load driving circuit that is configured to supply a proper output voltage to each capacitive load by reducing the variation in output signal pulse width that occurs in such cases as when delay time is adjusted by a delay circuit. Furthermore, according to the present invention, it becomes possible to achieve a plasma display apparatus that can supply a plasma display panel with a drive voltage free from such problems as the reduction of time margin and the occurrence of abnormal current and noise.

Many different embodiments of the present invention may be constructed without departing from the spirit and scope of the present invention, and it should be understood that the present invention is not limited to the specific embodiments described in this specification, except as defined in the appended claims.

What is claimed is:

1. A capacitive load driving circuit, comprising:

an input terminal;

a rising edge delay circuit delaying a rising edge of an input signal input via said input terminal;

a falling edge delay circuit delaying a falling edge of said input signal;

an amplifying circuit amplifying a drive control signal obtained through said rising edge delay circuit and said falling edge delay circuit; and an output switch device driven by said amplifying circuit, wherein:

said rising edge delay circuit comprises a capacitive element and a parallel circuit of a resistive element, and a switch element, and when said input signal rises, said capacitive element is charged through said resistive element and, when said input signal falls, said capacitive element is discharged through said switch element.

2. The capacitive load driving circuit as claimed in claim 1, wherein said input signal is a positive polarity pulse signal.

3. The capacitive load driving circuit as claimed in claim 1, wherein said switch element in said rising edge delay circuit is a diode.

4. The capacitive load driving circuit as claimed in claim 1, wherein the delay time of said rising edge delay circuit is adjusted by varying the resistance value of said resistive element.

5. The capacitive load driving circuit as claimed in claim 1, wherein the delay time of said rising edge delay circuit is adjusted by varying the capacitance value of said capacitive element.

6. A capacitive load driving circuit, comprising:

an input terminal;

a rising edge delay circuit, delaying rising edge of an input signal input via said input terminal;

a falling edge delay circuit, delaying a falling edge of said input signal;

an amplifying circuit amplifying a drive control signal obtained through said rising edge delay circuit and said falling edge delay circuit; and an output switch device which is driven by said amplifying circuit, wherein:

said falling edge delay circuit comprises a capacitive element and a parallel circuit of a resistive element and a switch element, and when said input signal falls, said capacitive element is charged through said resistive element and, when said input signal rises, said capacitive element is discharged through said switch element.

7. The capacitive load driving circuit as claimed in claim 6, wherein said switch element in said falling edge delay circuit is a diode.

8. The capacitive load driving circuit as claimed in claim 6, wherein the delay time of said falling edge delay circuit is adjusted by varying the resistance value of said resistive element.

9. The capacitive load driving circuit as claimed in claim 6, wherein the delay time of said falling edge delay circuit is adjusted by varying the capacitance value of said capacitive element.

10. A capacitive load driving circuit, comprising:

an input terminal;

a falling edge delay circuit, delaying a falling edge of an input signal input via said input terminal;

a rising edge delay circuit, delaying a rising edge of said input signal;

an amplifying circuit amplifying a drive control signal obtained through said falling edge delay circuit and said rising-edge delay circuit; and an output switch device driven by said amplifying circuit, wherein:

said rising edge delay circuit comprises a capacitive element and a parallel circuit of a resistive element and a switch element, and when said input signal rises, said capacitive element is charged through said resistive element and, when said input signal falls, said capacitive element is discharged through said switch element.

11. The capacitive load driving circuit as claimed in claim 10, wherein said input signal is a negative polarity pulse signal.

12. The capacitive load driving circuit as claimed in claim 10, wherein said switch element in said rising edge delay circuit is a diode.

13. The capacitive load driving circuit as claimed in claim 10, wherein the delay time of said rising edge delay circuit is adjusted by varying the resistance value of said resistive element.

14. The capacitive load driving circuit as claimed in claim 10, wherein the delay time of said rising edge delay circuit is adjusted by varying the capacitance value of said capacitive element.

15. A capacitive load driving circuit, comprising:

an input terminal;

a falling edge delay circuit, delaying a falling edge of an input signal input via said input terminal;

a rising edge delay circuit, delaying a rising edge of said input signal;

an amplifying circuit amplifying a drive control signal obtained through said falling edge delay circuit and said rising edge delay circuit; and an output switch device which is driven by said amplifying circuit, wherein:

said falling edge delay circuit comprises a capacitive element and a parallel circuit of a resistive element and a switch element, and when said input signal falls, said capacitive element is charged through said resistive element, and when said input signal rises, said capacitive element is discharged through said switch element.

16. The capacitive load driving circuit as claimed in claim 15, wherein said switch element in said falling edge delay circuit is a diode.

17. The capacitive load driving circuit as claimed in claim 15, wherein the delay time of said falling edge delay circuit is adjusted by varying the resistance value of said resistive element.

18. The capacitive load driving circuit as claimed in claim 15, wherein the delay time of said falling edge delay circuit is adjusted by varying the capacitance value of said capacitive element.

19. A capacitive load driving circuit, comprising:

an input terminal;

a front-edge delay circuit delaying a front edge of an input signal input via said input terminal;

a back-edge delay circuit delaying a back edge of said input signal;

an amplifying circuit amplifying a drive control signal obtained through said front-edge delay circuit and said back-edge delay circuit; and an output switch device driven by said amplifying circuit, wherein:

said front-edge delay circuit comprises a first capacitive element and a first series circuit having a first resistive element and a first switch element, said back-edge delay circuit comprises a second capacitive element and a second series circuit having a second resistive element and a second switch element, and, said first series circuit and said second series circuit are connected in parallel.

20. The capacitive load driving circuit as claimed in claim 19, wherein said first capacitive element and said second capacitive element are together constructed as one common capacitive element.

21. The capacitive load driving circuit as claimed in claim 19, wherein the delay time of the front edge of said input signal is adjusted by varying the resistance value of said first resistive element, and delay time of the back edge of said input signal is adjusted by varying the resistance value of said second resistive element.

22. The capacitive load driving circuit as claimed in claim 19, wherein said first switch element and said second switch element are diodes.

23. A capacitive load driving circuit, comprising:

an input terminal;

a front-edge delay circuit delaying a front edge of an input signal input via said input terminal;

a back-edge delay circuit delaying a back edge of said input signal;

an amplifying circuit amplifying a drive control signal obtained through said front-edge delay circuit and said back-edge delay circuit; and an output switch device is driven by said amplifying circuit, wherein:

said front-edge delay circuit comprises a first resistive element and a first capacitive element, said back-edge delay circuit comprises a second capacitive element and a series circuit having a second resistive element and a switch element, and said first resistive element and said series circuit are connected in parallel.

24. The capacitive load driving circuit as claimed in claim 23, wherein said first capacitive element and said second capacitive element are together constructed as one common capacitive element.

25. The capacitive load driving circuit as claimed in claim 23, wherein the delay time of the front edge of said input signal is adjusted by varying the resistance value of said first resistive element, and delay time of the back edge of said input signal is adjusted by varying the resistance value of said second resistive element.

26. The capacitive load driving circuit as claimed in claim 23, wherein the delay time of the front edge of said input signal is adjusted by varying the resistance value of said first resistive element, and thereafter, delay time of the back edge of said input signal is adjusted by varying the resistance value of said second resistive element.

27. The capacitive load driving circuit as claimed in claim 23, wherein said switch element is a diode.

28. A capacitive load driving circuit, comprising:

an input terminal;

a front-edge delay circuit delaying a front edge of an input signal input via said input terminal, said front-edge delay circuit comprising a first counter which starts to count a clock signal from the front edge of said input signal;

a back-edge delay circuit delaying a back edge of said input signal, said back-edge delay circuit comprising a second counter which starts to count said clock signal from the back edge of said input signal;

an amplifying circuit for amplifying a drive control signal obtained through said front-edge delay circuit and said back-edge delay circuit; and an output switch device which is driven by said amplifying circuit, wherein:

a delay time of said front edge is adjusted by varying a count value of said first counter, and a delay time of said back edge is adjusted by varying a count value of said second counter.

29. The capacitive load driving circuit as claimed in claim 28, wherein said first counter and said second counter are formed on the same semiconductor integrated circuit.

30. A capacitive load driving circuit, comprising:

a first and a second capacitive load driving circuit, each of the first and second capacitive load driving circuits comprising:

an input terminal, a front-edge delay circuit delaying a front edge of an input signal input via said input terminal, a back-edge delay circuit delaying a back edge of said input signal, an amplifying circuit amplifying a drive control signal obtained through said front-edge delay circuit and said back-edge delay circuit, and an output switch device which is driven by said amplifying circuit;

a first output switch device in said first capacitive load driving circuit connected between a power line and a capacitive load; and a second output switch device in said second capacitive load driving circuit connected between said capacitive load and a reference voltage.

31. The capacitive load driving circuit as claimed in claim 30, wherein:

said capacitive load driving circuit further comprises third and fourth capacitive load driving circuits;

a third output switch device in said third capacitive load driving circuit is connected to said capacitive load via a first coil; and a fourth output switch device in said fourth capacitive load driving circuit is connected to said capacitive load via a second coil.

32. The capacitive load driving circuit as claimed in claim 30, wherein:

said power supply line is a sustain power supply line of a plasma display apparatus.

33. A capacitive load driving circuit comprising:

an input terminal;

a front-edge delay circuit, comprising a resistive element and a capacitive element, delaying a front edge of an input signal input via said input terminal;

a pulse width adjusting circuit, comprising a monostable multivibrator, generating a drive control signal having a prescribed pulse width from a delayed signal obtained through said front-edge delay circuit, an amplifying circuit for amplifying said drive control signal; and an output switch device which is driven by said amplifying circuit.

34. The capacitive load driving circuit as claimed in claim 33, wherein the delay time of said input signal is adjusted by varying the resistance value of said resistive element in said front-edge delay circuit.

35. The capacitive load driving circuit as claimed in claim 33, wherein the delay time of said input signal is adjusted by varying the capacitance value of said capacitive element in said front-edge delay circuit.

36. The capacitive load driving circuit as claimed in claim 33, wherein the pulse width of said drive control signal is adjusted by varying a time constant and the like of said monostable multivibrator.

37. A capacitive load driving circuit, comprising:

a front-edge delay circuit, comprising a first counter counting a clock signal and delaying a front edge of an input signal input via said input terminal; and a pulse width adjusting circuit generating a drive control signal having a prescribed pulse width from a delayed signal obtained through said front-edge delay circuit, said pulse width adjusting circuit comprising a second counter counting said clock signal, wherein:

the delay time of said input signal is adjusted by varying a count value of said first counter, and the pulse width of said drive control signal is adjusted by varying a count value of said second counter;

an amplifying circuit amplifying said drive control signal; and an output switch device driven by said amplifying circuit.

38. A capacitive load driving circuit, comprising:

first and second capacitive load driving circuits, each of the first and second capacitive load driving circuits comprising:

an input terminal, a front-edge delay circuit delaying a front edge of an input signal input via said input terminal, a pulse width adjusting circuit generating a drive control signal having a prescribed pulse width from a delayed signal obtained through said front-edge delay circuit, an amplifying circuit amplifying said drive control signal, and an output switch device driven by said amplifying circuit;

a first output switch device in said first capacitive load driving circuit connected between a power line and a capacitive load; and a second output switch device in said second capacitive load driving circuit connected between said capacitive load and a reference voltage.

39. The capacitive load driving circuit as claimed in claim 38, wherein:

said capacitive road driving circuit further comprises a third and a fourth capacitive load driving circuit;

a third output switch device in said third capacitive load driving circuit is connected to said capacitive load via a first coil; and a fourth output switch device in said fourth capacitive load driving circuit is connected to said capacitive load via a second coil.

40. The capacitive load driving circuit as claimed in claim 38, wherein said power supply line is a sustain power supply line of a plasma display apparatus.

41. A plasma display apparatus, comprising:

a plurality of X electrodes;

a plurality of Y electrodes which are arranged substantially parallel to said plurality of X electrodes, and which produce a discharge between said plurality of Y electrodes and said plurality of X electrodes;

an X-electrode driving circuit which applies a discharge voltage to said plurality of X electrodes; and a Y-electrode driving circuit which applies a discharge voltage to said plurality of Y electrodes, and wherein said X-electrode driving circuit or said Y-electrode driving circuit is constructed using a capacitive load driving circuit as recited in any one of claims 1, 6, 10, 15, 19, 23, 28, 30, 33, 37 and 38.

42. A plasma display apparatus, comprising:

a plurality of X electrodes;

a plurality of Y electrodes which are arranged substantially parallel to said plurality of X electrodes, and which produce a discharge between said plurality of Y electrodes and said plurality of X electrodes;

an X-electrode driving circuit which applies a discharge voltage to said plurality of X electrodes; and a Y-electrode driving circuit which applies a discharge voltage to said plurality of Y electrodes, and wherein said X-electrode driving circuit or said Y-electrode driving circuit is constructed using a capacitive load driving circuit as recited in any one of claims 1, 6, 10, 15, 19, 23, 28, 30, 33, 37, and 38.

* * * * *

UNITED STATES PATENT AND TRADEMARK OFFICE

CERTIFICATE OF CORRECTION

PATENT NO. : 7,015,905 B2
APPLICATION NO. : 10/759072
DATED : March 21, 2006
INVENTOR(S) : Makoto Onozawa et al.

It is certified that error appears in the above-identified patent and that said Letters Patent is hereby corrected as shown below:

Column 19, line 11, after “delaying” insert -- a --

Column 19, line 47, delete “rising-edge” and insert -- rising edge --

Column 20, line 52, after “and” delete “,”

Column 22, line 29, after “circuit” insert -- , --

Column 23, line 27, delete “road” and insert -- load --

Signed and Sealed this

Twenty-third Day of January, 2007

JON W. DUDAS
*Director of the United States Patent and Trademark Office*